US007128231B2

(12) United States Patent
Overholt

(10) Patent No.: US 7,128,231 B2
(45) **Date of Patent: *Oct. 31, 2006**

(54) COLLAPSIBLE CONTAINER

(75) Inventor: Trenton M. Overholt, Manhattan Beach, CA (US)

(73) Assignee: Rehrig Pacific Company, Los Angeles, CA (US)

( * ) Notice: Subject to any disclaimer, the term of this patent is extended or adjusted under 35 U.S.C. 154(b) by 394 days.

This patent is subject to a terminal disclaimer.

(21) Appl. No.: 10/677,499

(22) Filed: Oct. 1, 2003

(65) Prior Publication Data

US 2004/0099662 A1 May 27, 2004

Related U.S. Application Data

(63) Continuation of application No. 09/698,654, filed on Oct. 28, 2000, now Pat. No. 6,631,822.

(51) Int. Cl.
*B65D 6/24* (2006.01)
*B65D 6/00* (2006.01)
*B65D 6/12* (2006.01)

(52) U.S. Cl. ..... 220/4.28; 220/4.1; 220/6

(58) Field of Classification Search ..... 220/4.28, 220/4.01, 4.34, 4.1; 200/6
See application file for complete search history.

(56) References Cited

U.S. PATENT DOCUMENTS 3,446,415 A 5/1969 Bromley
3,628,683 A 12/1971 Friedrich
3,796,342 A 3/1974 Sanders et al.
3,874,546 A 4/1975 Sanders et al.
3,973,692 A 8/1976 Cloyd
4,005,795 A 2/1977 Mikkelsen et al.
4,044,910 A 8/1977 Box
4,062,467 A 12/1977 Friedrich
4,081,099 A 3/1978 Shead
4,163,495 A 8/1979 Drader
4,170,313 A 10/1979 Caves et al.
4,181,236 A 1/1980 Prodel
4,235,345 A 11/1980 VandeDrink et al.
4,300,695 A 11/1981 Hsu
4,314,686 A 2/1982 März
4,349,120 A 9/1982 DiNardo
4,591,065 A 5/1986 Foy
4,663,803 A 5/1987 Gora
4,674,647 A 6/1987 Gyenge et al.
4,735,331 A 4/1988 Keenan et al.
4,741,032 A 4/1988 Hampton
4,765,480 A 8/1988 Malmanger
4,775,068 A 10/1988 Reiland et al.
4,776,457 A 10/1988 Ferraroni
4,781,300 A 11/1988 Long
4,809,874 A 3/1989 Pehr
4,820,383 A 4/1989 Shchamorov et al.
4,846,089 A 7/1989 Cedergreen
4,887,747 A 12/1989 Ostrowsky et al.

(Continued)

FOREIGN PATENT DOCUMENTS

DE 27 34 964 A1 2/1979

(Continued)

*Primary Examiner*—Jes F. Pascua
*Assistant Examiner*—Shawn M. Braden

(57) ABSTRACT

A collapsible container having a base with opposed edges, first and second pairs of side walls pivotably attached to opposed edges of the base, one pair of side walls having a lateral edge, and the other having a lateral flange inwardly depending therefrom, the lateral edge being selectively connected to the lateral flange by a latch, the latch including a latch member and at least one clip member.

16 Claims, 20 Drawing Sheets

U.S. PATENT DOCUMENTS

| | | | | |
|---|---|---|---|---|
| D306,264 | S | | 2/1990 | Malmanger |
| 4,917,255 | A | | 4/1990 | Foy |
| 4,923,079 | A | | 5/1990 | Foy |
| 4,940,155 | A | | 7/1990 | Hewson |
| 4,960,223 | A | | 10/1990 | Chiang et al. |
| 4,967,927 | A | | 11/1990 | Reiland et al. |
| 4,979,634 | A | | 12/1990 | Begley |
| 5,038,953 | A | | 8/1991 | Radar |
| 5,048,715 | A | | 9/1991 | Wolff |
| 5,076,457 | A | | 12/1991 | Marovskis |
| 5,114,037 | A | | 5/1992 | Hillis et al. |
| 5,161,709 | A | | 11/1992 | Oestreich, Jr. |
| 5,183,180 | A | | 2/1993 | Hawkins et al. |
| 5,289,935 | A | | 3/1994 | Hillis et al. |
| 5,328,048 | A | | 7/1994 | Stein |
| 5,353,948 | A | | 10/1994 | Lanoue et al. |
| 5,398,834 | A | | 3/1995 | Umiker |
| 5,429,261 | A | | 7/1995 | Machino |
| 5,467,885 | A | | 11/1995 | Blinstrub |
| 5,474,197 | A | | 12/1995 | Hillis et al. |
| 5,474,200 | A | | 12/1995 | Nicholson |
| 5,515,987 | A | | 5/1996 | Jacques et al. |
| 5,564,599 | A | | 10/1996 | Barber et al. |
| 5,588,549 | A | | 12/1996 | Furtner |
| 5,622,276 | A | | 4/1997 | Simmons |
| 5,632,392 | A | | 5/1997 | Oh |
| 5,699,926 | A | | 12/1997 | Jacques et al. |
| 5,829,617 | A | | 11/1998 | Umiker |
| 5,850,936 | A | | 12/1998 | Umiker |
| 5,853,099 | A | | 12/1998 | Lessard |
| 5,975,324 | A | | 11/1999 | Schmitt |
| 6,015,056 | A | | 1/2000 | Overholt et al. |
| 6,029,840 | A | | 2/2000 | Brauner |
| D423,217 | S | | 4/2000 | Varfeldt |
| 6,073,790 | A | * | 6/2000 | Umiker ..... 220/6 |
| 6,098,827 | A | | 8/2000 | Overholt et al. |
| 6,131,757 | A | | 10/2000 | Clark et al. |
| 6,142,329 | A | | 11/2000 | Dotan |
| 6,170,689 | B1 | * | 1/2001 | Flesher et al. ..... 220/7 |
| 6,189,695 | B1 | | 2/2001 | Ching-rong |
| 6,286,701 | B1 | | 9/2001 | Umiker |
| 6,293,418 | B1 | * | 9/2001 | Ogden et al. ..... 220/7 |
| 6,383,388 | B1 | * | 5/2002 | Krauter et al. ..... 210/611 |
| 6,386,388 | B1 | | 5/2002 | Overholt |
| 6,398,054 | B1 | | 6/2002 | Overholt et al. |
| 6,405,888 | B1 | | 6/2002 | Overholt et al. |
| 6,409,041 | B1 | | 6/2002 | Overholt et al. |
| 6,631,822 | B1 | * | 10/2003 | Overholt ..... 220/7 |
| 6,820,761 | B1 | * | 11/2004 | Mouri et al. ..... 220/6 |

FOREIGN PATENT DOCUMENTS

| | | | |
|---|---|---|---|
| DE | 43 19 099 | A1 | 12/1994 |
| EP | 0 127 414 | | 12/1984 |
| EP | 0 178211 | A1 | 9/1985 |
| EP | 0 404041 | A1 | 12/1990 |
| EP | 0 485 672 | A1 | 5/1992 |
| WO | WO 86/01182 | | 2/1986 |
| WO | WO 97/15502 | | 1/1997 |

* cited by examiner

COLLAPSIBLE CONTAINER

CROSS-REFERENCE TO RELATED APPLICATION

This application is a continuation of application Ser. No. 09/698,654 filed Oct. 28, 2000, now U.S. Pat. No. 6,631, 822.

TECHNICAL FIELD

This invention relates to a collapsible container adaptable for the storing and transporting produce items and other goods.

BACKGROUND ART

Plastic containers and crates are commonly used today to transport and store a variety of items. When in use, such containers are typically rectangular in shape and have a base surrounded by four upstanding side panels. When not in use, many of the plastic containers employed by the produce and food industries have panels which are capable of folding both outwardly and inwardly. The folding feature, and particularly the inwardly folding feature, allows the containers to be folded or otherwise reduced in size for conserving storage space. In practicality, while the outwardly collapsing feature allows the container to generally have a lower profile than when in the inwardly folded position, the outwardly folding feature is underutilized, as the container with outwardly folded panels is often bulky, awkward to carry, and may not nest or stack easily with like folded containers.

Furthermore, folding containers are often formed of various components, including the side panels and the base, which are molded separately. In particular, the walls typically include strengthening ribs on their outer surfaces in order to provide strength and torsional resistance to the parts. However, during the molding process, the components having ribs may be subject to slight warpage and deformation during cooling, when plastic tends to shrink. The warping may particularly occur at the edges of the parts. Under these circumstances, the parts may have lower dimensional accuracy individually as well as with mating components, and may result in scrapped parts, and elevated manufacturing and part costs.

When assembled and in use, adjoining walls of some present containers are typically locked together by a latch mechanism, requiring additional user handling and manipulation of the latch in order to unlock and unfold the walls prior to storage. One such container and latch mechanism is disclosed in U.S. Pat. No. 6,015,086, which is assigned to the assignee of the present invention. While such locking latch mechanisms are sturdy and effective, the user in the field may not be able to apply the extra handling and manual disengagement necessary to release the latch and collapse the locked container. In fact, on some containers, it is sometimes necessary to use both hands to release the locking features.

In present containers, the side panels and base have adjoining hinge features, whereby the side panels are typically snapped into the base via an interference fit. This often requires strength and effort, and once snapped together the panels may be difficult to separate from the base, whereby separating the components may result in deformation of the parts.

Consequently, an improved container is desired which has walls which are relatively easy to latch and unlatch without excessive user handling and manipulation. The container, when in the assembled orientation, should also have the requisite strength properties capable of supporting the load and forced placed on these walls. The container and its components should also be resistant to warpage during the molding and cooling process. The container should provide for a relatively low profile when the walls are in the inwardly folded position. The components (particularly walls from base) should also be easily assembled and disassembled without deformation. The container should also allow for efficient wall movement and usage.

DISCLOSURE OF INVENTION

It is an object according to the present invention to provide a container which is relatively easy to latch and unlatch without excessive user handling of the latch mechanism.

It is another object according to the present invention to provide a container which is capable of supporting the forces and load placed on the container walls, particularly during handling and during the unlatching and latching of the container.

It is still another object according to the present invention to provide a container having components which are resistant to warpage during the cooling and/or curing phases of the molding process.

Still other objects according to the present invention are to provide a container that is relatively easy to collapse, which has a very low profile when in the collapsed orientation, and which is easily assembled and disassembled.

In keeping with the above objects and goals according to the present invention, provided is a collapsible container which includes a floor member having first and second pairs of opposed edges, and a first pair of opposing side walls each pivotably attached to the first pair of opposed edges of the base. Each of the first pair of opposing side walls has a pair of lateral edges and a latch member extending therefrom. Also included is a second pair of opposed side walls each pivotably attached to a corresponding one of the second pair of opposed edges of the base, each of the second pair of opposed side walls having a pair of opposed lateral flanges inwardly depending therefrom and formed integrally therewith, each lateral flange having an inner surface with a latch receiving portion formed therein. The latch receiving portion includes at least one clip member having a spring portion flexible between a first position and a second position for accepting the latch member, such that when the container is oriented in an assembled position, the at least one clip member receives a corresponding latch member, and wherein to move the container to an inwardly collapsed position from the assembled position, a force is exerted against an exterior surface of each of the first pair of opposed sidewalls. The force sufficient for the latch member to overcome the spring portion and be released from the at least one clip member. Preferably, when the container is oriented in the inwardly collapsed position, the first pair of opposing side walls are pivotably folded inward adjacent the base, and the second pair of opposing sidewalls are pivotably folded inward such that the first pair of opposed side walls is layered between the second pair of opposed side walls and the base.

In further keeping with the teachings and goals of the present invention, also provided is a collapsible container orientable between an assembled position and an inwardly collapsed position and includes a base member having a floor with a pair of opposed upstanding flanges integrally formed therewith, the upstanding flanges having an upper surface. Also included is a pair of first opposed walls which are pivotably mounted to the base, where each of the first opposed walls have side edges with at least one latch portion extending laterally therefrom, the latch portion including at least one latch member. Further included is a pair of second opposed side walls pivotably attached to a corresponding upstanding flange proximate the upper surface thereof, each of the pair of second opposed side walls having a pair of opposed, inwardly directed flanges having an inner surface with a latch receiving area formed therein, the latch receiving area defined by at least one latch acceptance member having a flexible portion for receiving a corresponding latch member therein in an interference fit when the container is oriented in the assembled position, and wherein to move the container to the collapsed position, a force sufficient to overcome the interference fit is applied to an exterior surface of each of the first opposed side walls. As disclosed, the base includes a periphery having a plurality of lower hinge members, each lower hinge member having a hook portion with a downwardly directed edge, and each of the pairs of first and second opposed sidewalls having a plurality of corresponding upper hinge members extending from a lower edge thereof. Each upper hinge member has a cam-shaped member for engaging the hook portion, such that as the container is moved from the inwardly collapsed position to the assembled position, the edge of the hook member limits the vertical movement of the cam-shaped member, thereby preventing each of the pairs of first and second opposed sidewalls from separating from the base when in the assembled position.

In further keeping with the goals and objects according to the present invention, a foldable container is provided which is orientable in an assembled position and an inwardly folded position. The container includes a bottom panel having a pair of integrally formed opposed upstanding flanged edges and a pair of opposed edges, and a pair of opposed end walls pivotably mounted to the pair of opposed edges, where each of the opposed end walls have a latching member extending from a corresponding lateral edge of the end wall and co-planar with the end wall. Also included is a pair of opposed side walls, each pivotably mounted to a corresponding upstanding flanged edge and having a U-shaped cross-section including a longer main wall portion and a pair of relatively shorter flanged portions attached to the main wall portion and inwardly directed therefrom, each flanged portion having an inner surface with a latch receiving portion formed therein for receiving the pair of latching members in an interference fit, wherein when the container is in the assembled position, the latching member is substantially co-planar with the flange inner surface. In a preferred embodiment, the pair of opposed end walls includes an anti-rotation member which engages the inner surface of the flanged portion when the container is in the assembled position in order to impede rotational movement of the pair of opposed side walls.

In further keeping with the goals and objects, a collapsible container includes a base which has first and second pairs of opposing edges, where one of the first and second pairs of opposing surfaces is defined by an upstanding base wall, and each of the first and second pairs of opposing edges includes a plurality of lower hinge members, each lower hinge members defined by an clearance opening and an adjacent hook portion having a downwardly directed edge. Also included is a first and second pair of opposed side walls, each having at least one upper hinge member having a bar with a projection extending therefrom, each of the second pair of opposed side walls mounted to a corresponding upstanding base wall and having a pair of opposed lateral flanges inwardly depending therefrom and integral therewith. Each lateral flange has a latch receiving portion formed therein, and each of the first pair of opposed side walls each has a pair of opposing lateral edges, each having a latch member extending therefrom. When the container is oriented in an assembled position, each latch receiving portion receives a latch member therein, and the projection of the upper hinge member engages the downward edge of the hook portion, thereby impeding the movement of the sidewalls outward beyond the assembled position.

In accordance with the objective and goals according to the present invention, provided is a collapsible container having a base member, and first and second pairs of opposed side walls, each pivotably attached to a periphery of the base member and each having an upper surface. At least one of the first and second pairs of opposed side walls includes an upper wall portion having an interior surface and an exterior surface, the upper wall portion including at least one first row portion and at least one second row portion. Each of the first and second row members extend at least partially across the length of the upper wall portion and oriented substantially parallel to the upper surface of the sidewall, each of the first and second row portions further having a first surface and second surface co-planar with the interior and exterior surface, respectively, of the upper wall portion. The first row portion has a peaked first surface and recessed second surface, and the second row portion has recessed first surface and a peaked second surface.

Further provided in accordance with the goals and objects herein is a wall structure for a collapsible container, where the wall structure has an inner surface and an opposed outer surface, and includes an upper edge and a plurality of row portions extending at least partially across the length of the wall structure proximate the upper edge and oriented substantially parallel thereto. A first of the plurality of row portions has an interior surface defining the inner surface of the wall structure, and an recessed outer surface defining the outer surface of the wall structure. A second of the plurality of rows is disposed parallel to the first row portion and has an exterior surface and a recessed interior surface.

Also disclosed herein is a collapsible container which is orientable between an assembled position and an inwardly folded position including a floor member, a first pair of opposed side walls having a first latch portion including at least one latch member, and a second pair of opposed side walls having a second latch portion including a flexible clip portion having a latch member acceptance area and a flex portion. When the container is moved from the inwardly folded position to the assembled position, the second pair of opposed side walls is rotated upward until it is oriented substantially perpendicular to the base, and the first pair of opposed side walls is rotated upwardly such that the at least one latch member is inserted into the opening of the flex portion, thereby expanding it until is it received within the latch member receiving area and the flex portion returns to its rest position, impeding the release of the at least one latch member. The at least one latch member is a dowel member having a bulbous head for being received by the clip portion in an interference fit. Also, the flexible clip portion is a C-shaped clip member and the flex portion is defined by an end of the C-shaped clip.

In further keeping with the goals and objects according to the present invention, provided is collapsible container having inwardly folding walls including a base member having a first hinge portion disposed proximate a periphery of the base member, the first hinge portion having an arcuate member with an first edge extending downwardly therefrom. Also provided is a first and second pair of opposed sidewalls having a second hinge portion pivotably attached to the first hinge portion of the base, wherein the second hinge portion comprises a semi-circular member having a edge extending therefrom such that to assemble the side walls and the base, each second hinge portion is received by the first hinge portion, and wherein when the wall is moved to its assembled position, the tooth of the second hinge portion is rotated to contact the first inner tooth of the first hinge portion, such that an interference fit exists between the teeth, preventing the walls from separating from the base member.

Further provided is a collapsible container adapted to move between a collapsed orientation position and an assembled orientation, including a base having first and second pairs of opposed edges, and a first pair of opposed side walls each pivotably attached to a corresponding one of the first pairs of opposed edges of the base. Each of the first pair of opposed side walls have a pair of opposed lateral edges, each lateral edge having a latch member disposed thereon. Also provided is a second pair of opposed side walls each pivotably attached to a corresponding one of the second pair of opposed edges of the base, each of the second pair of opposed side walls having a pair of opposed flanges inwardly depending therefrom, each flange having a surface with at least one latch receiving member formed therein having a flexible portion. When the container is moved from the collapsed orientation to the assembled orientation, each wall rotates upward such that the at least one latch receiving member receives by interference a corresponding latch member thereby displacing the flexible portion from a rest position to the second position, and wherein when the container is in the assembled position, the flexible portion returns to the rest position for securing the latch member. Preferably, when the container is oriented in the collapsed position, the first and second pairs of opposed side walls are folded inward so that one of the first and second pairs of opposed side walls is layered between the other of the first and second pairs of opposed side walls and the base. Also, the first and second pairs of opposed edges include a plurality of lower hinge members having an hinge opening at each end for pivotably receiving therein a pivot member disposed on a corresponding side wall.

Also provided according to the goals and objects herein is a collapsible container orientable between an assembled position and a collapsed position and including a base having a pair of opposed end edges and a pair of opposed side edges extending between the pair of opposed end edges, and a pair of opposed end walls pivotably attached to a corresponding one of the opposed end edges of the base. Each opposed end wall has a lateral edge and a latch member disposed thereon. Also included is a pair of opposed side walls each having a pair of flanges inwardly depending therefrom. The flanges have an inwardly directed surface with a flexible clip portion having an expandable opening portion such that as the container is rotated from the collapsed position to the assembled position, and the latch member is secured by the clip portion in the assembled position.

Further provided herein is a wall structure for a container, preferably collapsible, includes an upper wall portion having an inner surface and an outer surface, the upper wall portion including a plurality of alternating row members extending at least partially across the length of the wall structure proximate an upper surface of the wall structure and oriented substantially parallel thereto. Each of the plurality of row members has a first surface and second surface co-planar with the inner and outer surface, respectively, of the upper wall portion, wherein at least one of the plurality of row members has a peaked first surface and recessed second surface. An other of the plurality of row members has a recessed first surface and a peaked second surface, and members extending between the adjacent first and second peak. Preferably, adjacent ones of said peaked first surfaces define a recessed first surface therebetween, and adjacent ones of said peaked second surfaces define a recessed second surface therebetween.

The above objects and other objects, features, and advantages of the present invention are readily apparent from the following detailed description of the best mode for carrying out the invention when taken in connection with the accompanying drawings.

BEST MODE FOR CARRYING OUT THE INVENTION

Figure 1:
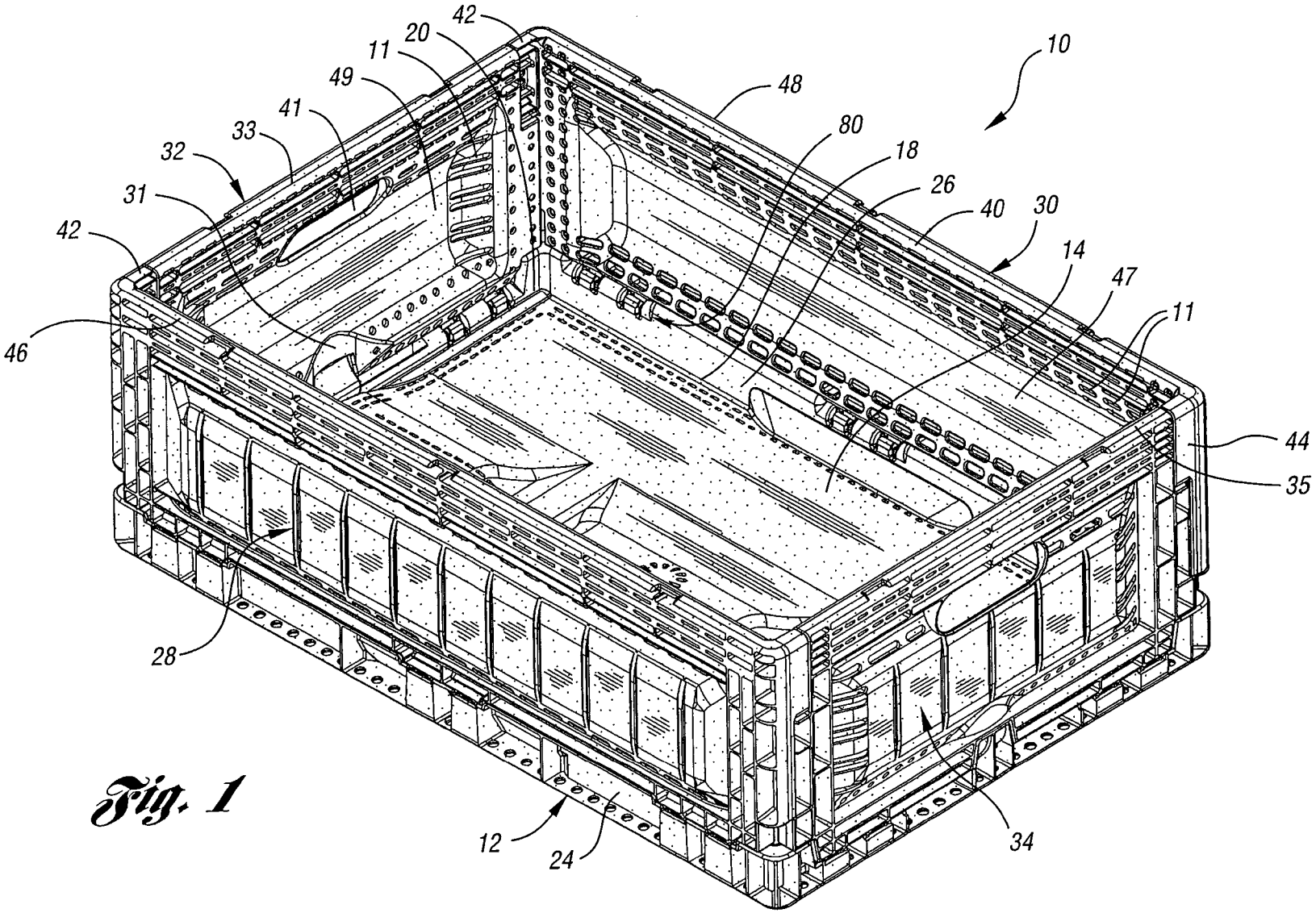
FIG. 1 of the drawings illustrates a perspective view of a container according to the present invention.
Figure 23:
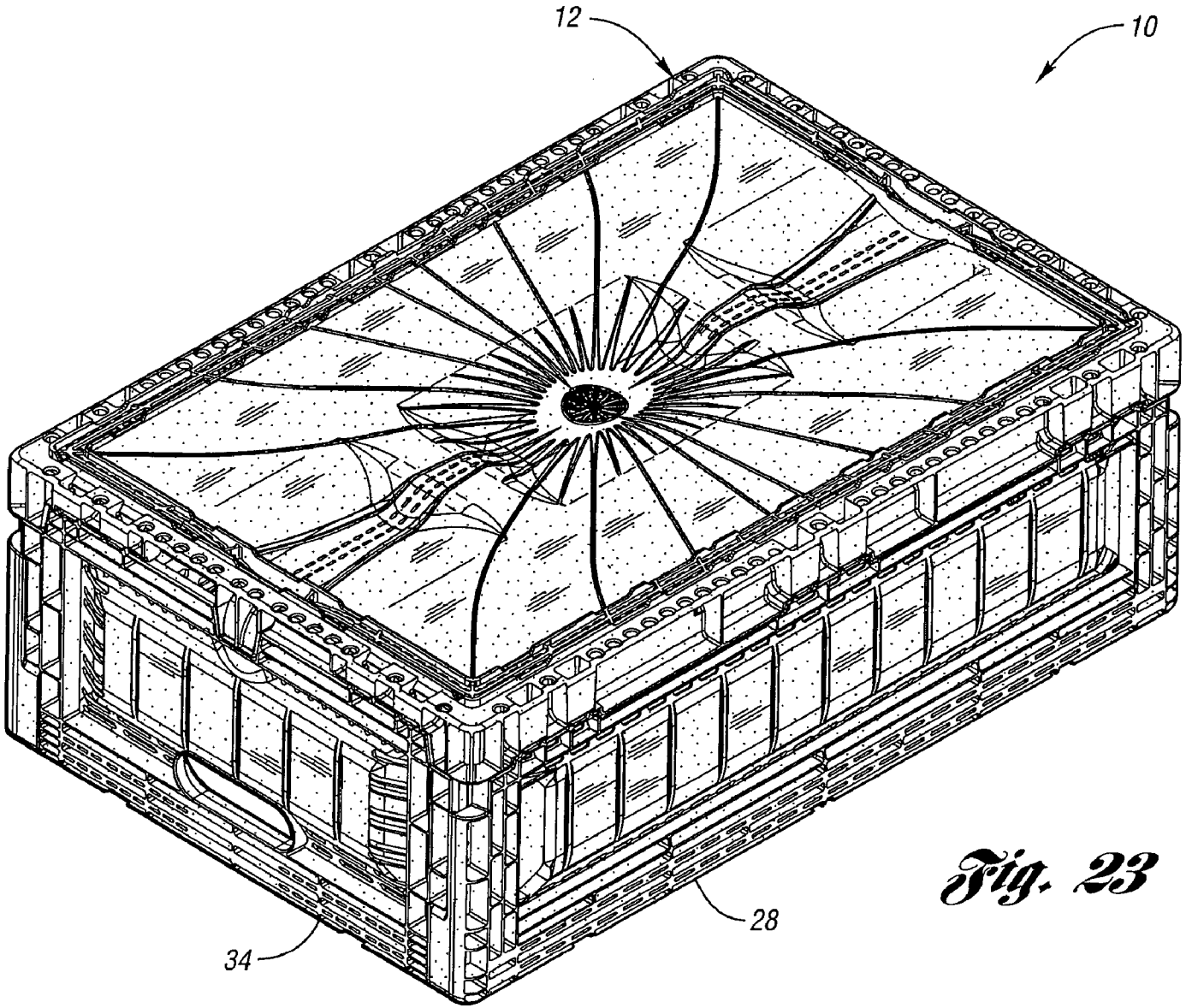
FIG. 23 illustrates a bottom perspective view of the container.

With reference to FIGS. 1 and 23 of the drawings, illustrated therein is a collapsible container 10 according to the present invention. Container 10 is also appropriately referred to as a collapsible crate or box. Container 10 is formed of a thermoplastic resin, such as polypropylene, via an injection molding process or other plastic molding process suitable to this application. While container 10 is suitable for many uses, it is particularly well-suited for the storage and transport of perishable goods and produce such as fruits and vegetables, and more particularly bananas, where the circulation of air and other gases within container 10 assists in developing and maintaining the produce freshness and ripening during shipment to the market. This circulation is fostered through venting apertures 11 provided throughout container 10.

Figure 2:
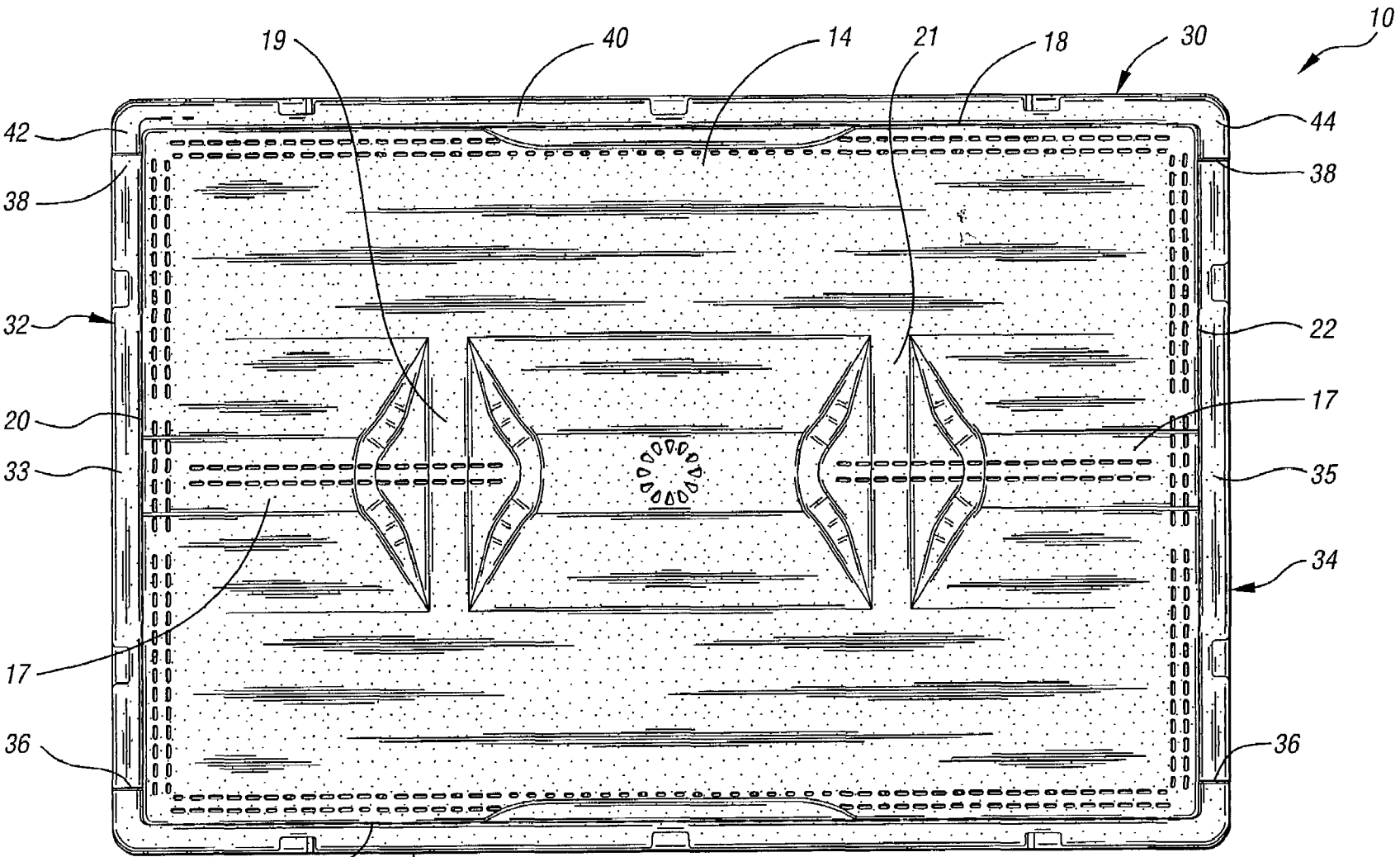
FIG. 2 illustrates a top plan view of the container of FIG. 1.
Figure 3:
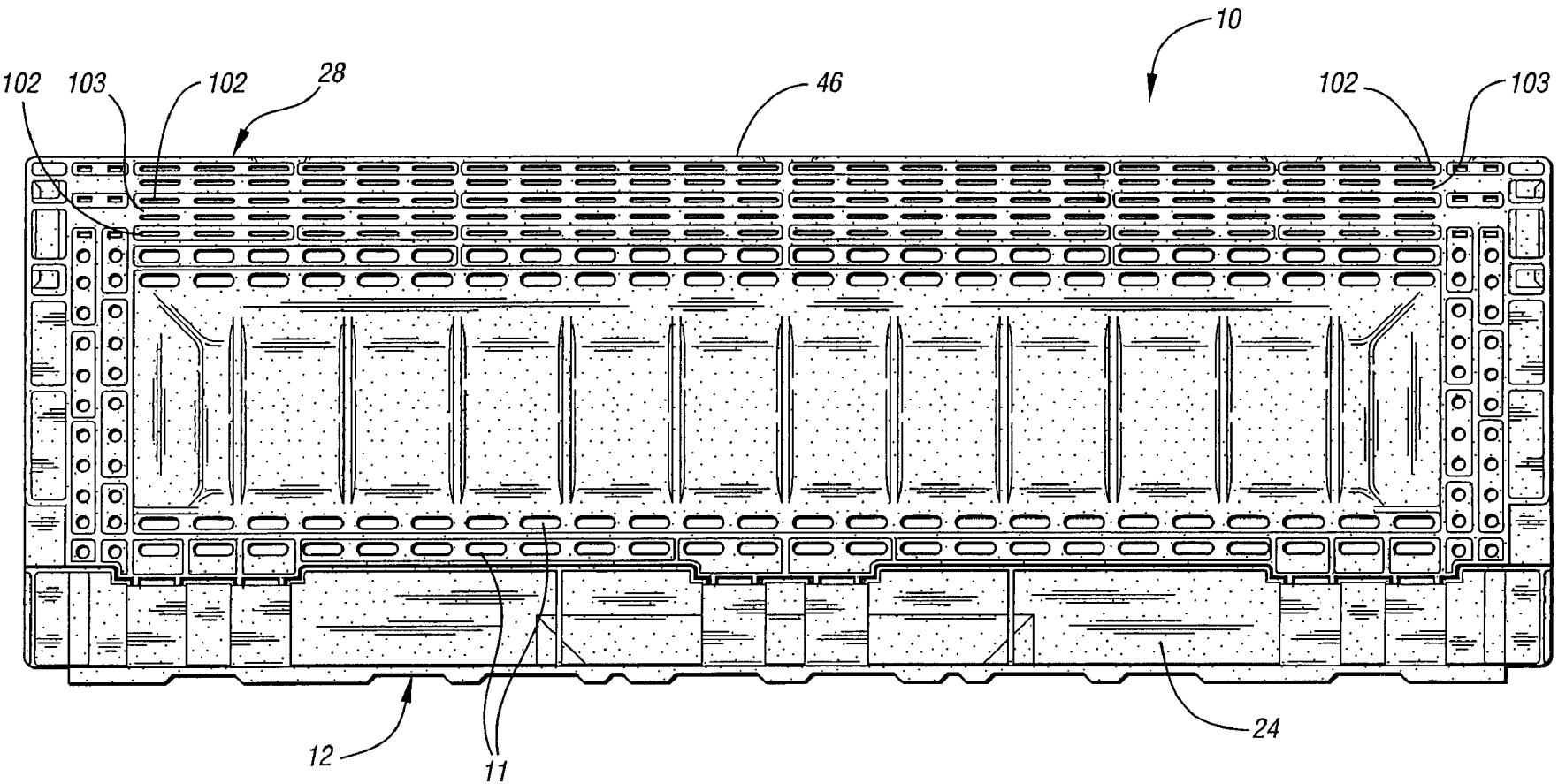
FIG. 3 illustrates a side elevational view of the container of FIG. 1, the opposite side being a mirror image thereof.
Figure 4:
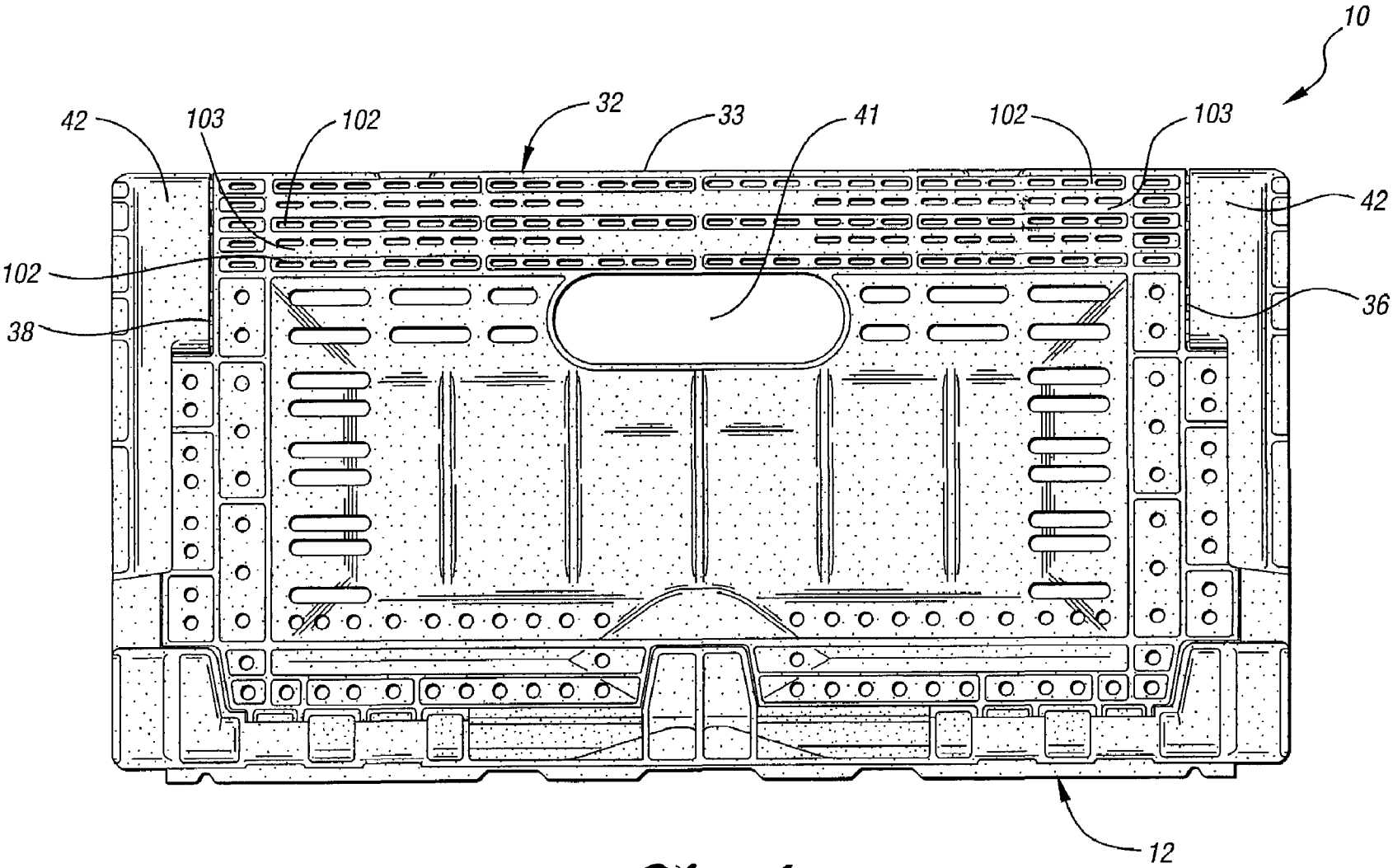
FIG. 4 illustrates an end elevational view of the container of FIG. 1, the opposite side being a mirror image thereof.
Figure 5:
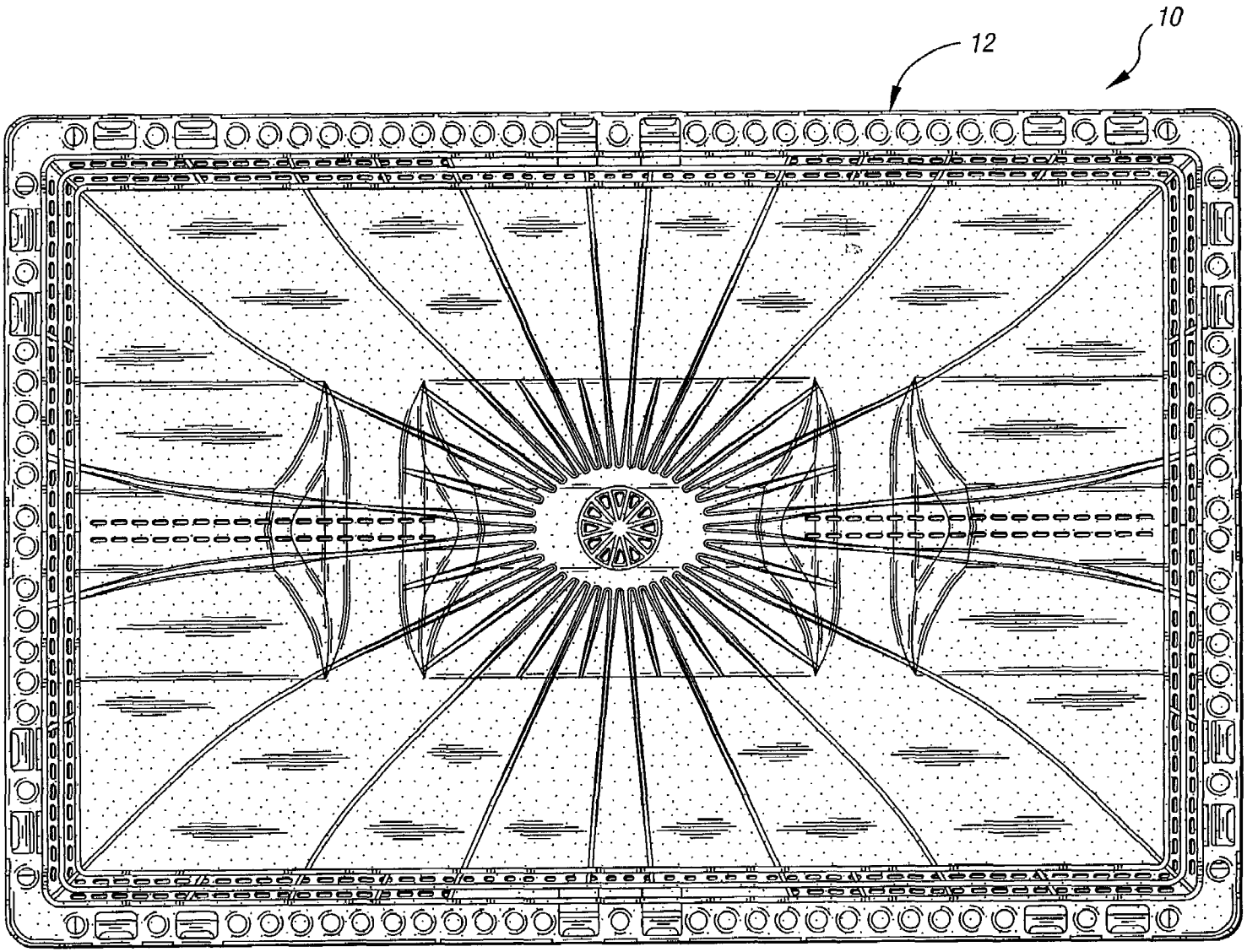
FIG. 5 is a bottom plan view of the container of FIG. 1.

As shown in FIGS. 1–5, container 10 includes a base member 12 having a bottom wall 14 which serves as the lower support for container 10. As best shown in FIGS. 2 and 5, bottom wall 14 is generally rectangular in shape and has four perimeter edges—namely, a first pair of opposed edges 16 and 18 (side edges), and a second pair of opposed edges 20 and 22 (end edges). In this embodiment, base 12 further includes integrally molded upstanding flanges 24 and 26 (or base side walls) which are oriented substantially perpendicular to bottom wall 14, each defining an upper side surface 25 and 27, respectively. The wall thickness of each of the walls and components illustrated and disclosed herein may vary depending on the intended usage and other characteristics desired from container 10. Moreover, while container 10 is illustrated as having a rectangular shape, it is fully contemplated that the teachings according to the present invention are equally applicable to a square container, or various other container shapes. Moreover, bottom wall 14 has a centrally disposed raised portion 17 for accommodating the natural shape of a banana bunch when in the hands down position.

Figure 20:
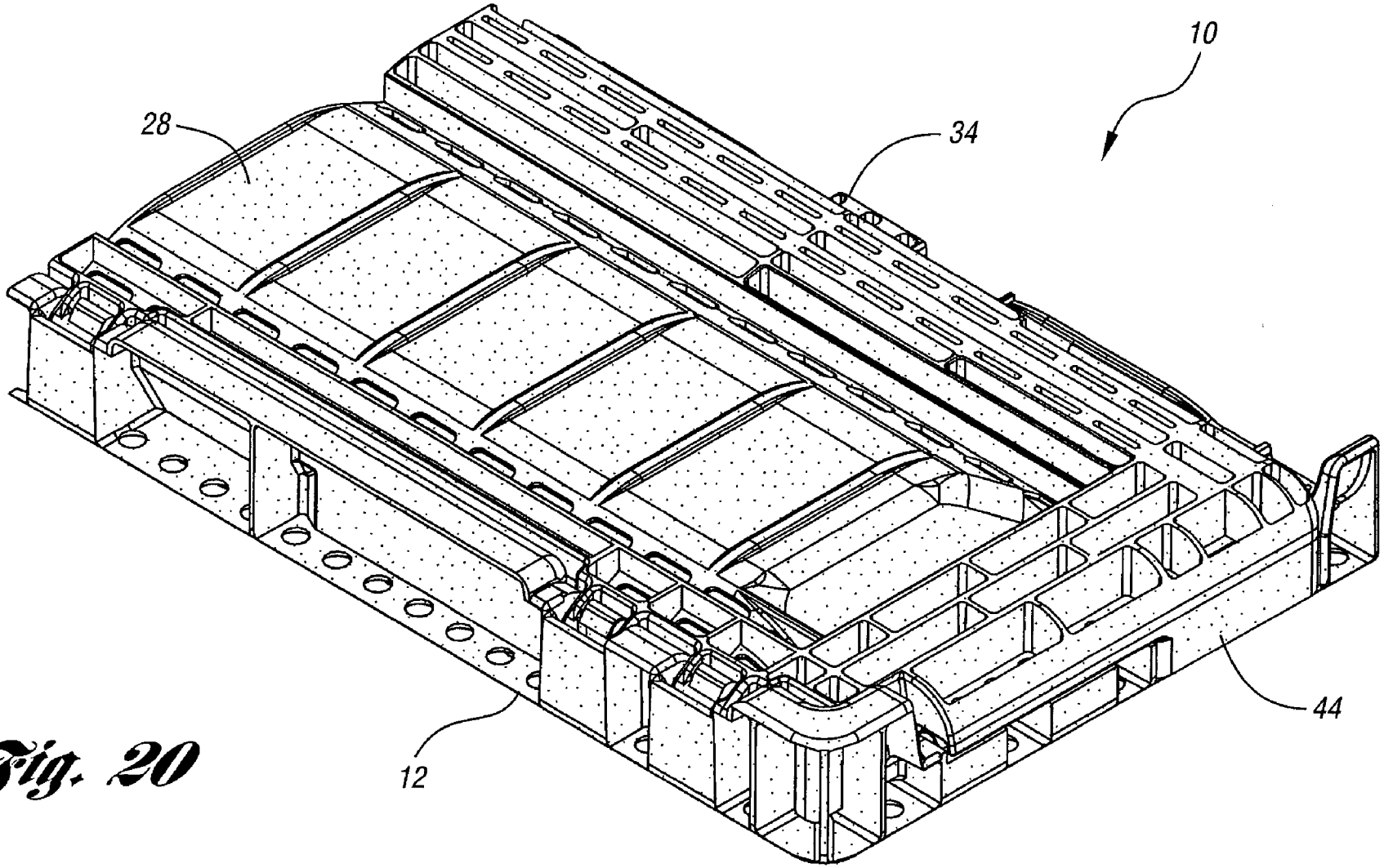
FIG. 20 is a partial perspective view of the container of FIG. 1, with both the end wall and the side wall in the inwardly collapsed position.

As shown in FIGS. 1–4, container 10 also includes a first pair of opposed side walls 28, 30, and a second pair of opposed side walls 32,34 (referred to as a pair of opposed end walls 32, 34.) Walls 28,30,32,34 are each attached to base 12 by way of a hinging system 80 (disclosed herein and best shown in FIGS. 14, 14*a*,15, 15*a*), located at an upper portion of upstanding flanges 24,26. Thus, side walls (28, 30) fold or pivot relative to base 12 proximate to upper surfaces 25, 27, at a distance remote from bottom panel 14. The height of upstanding base wall flanges 24, 26 defines the aforementioned distance from which side walls 28,30 are remote from bottom panel 14. Such base and wall configuration, in addition to hinging system 80, allows walls 28,30,32,34 to have two orientations: the assembled container orientation of container 10 as illustrated in FIG. 1, and an inwardly collapsed orientation as illustrated in FIG. 20.

Figure 19:
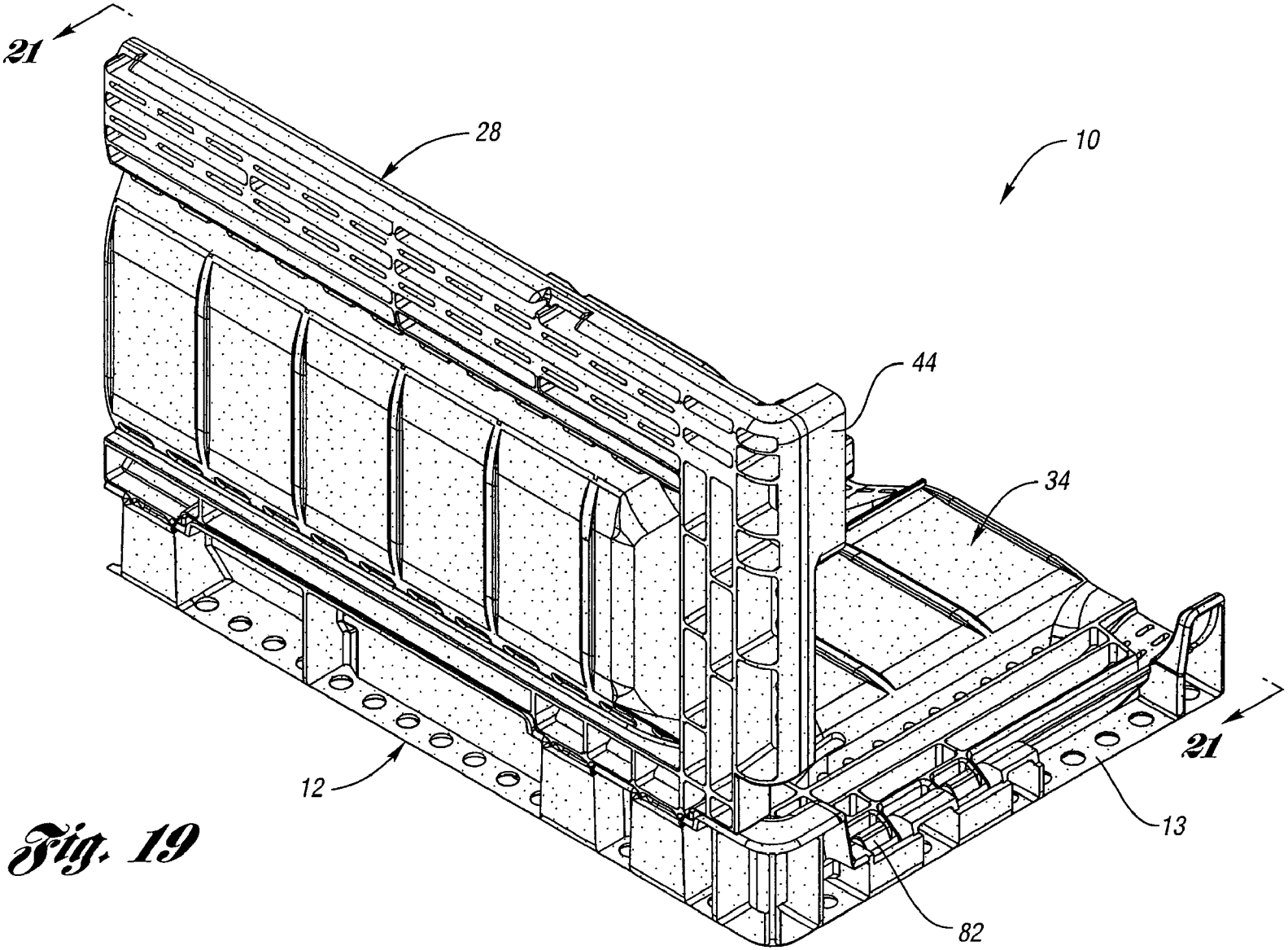
FIG. 19 is a partial perspective view of the container of FIG. 1, with the end wall collapsed inwardly, and the side wall upstanding.

As best shown in FIGS. 1, 2 and 19, each side wall 28,30 has a U-shaped cross section formed by a main side wall portion 40, and two shorter flange portions 42 and 44 integrally attached to main side wall portion 40 and located on either side of main side wall portion 40. Flange portions 42,44 are each oriented perpendicular to main side wall portion 40 and, in the assembled orientation of FIG. 1, are directed inward toward the opposite side wall (28 or 30), and disposed adjacent end walls 32,34. As shown in FIGS. 1 and 4, each end wall (32, 34) includes a hand opening 41, which along with the wall portion located thereabove is ideally suited to be used as a handle in order to carry container 10 when assembled and in use.

Figure 7:
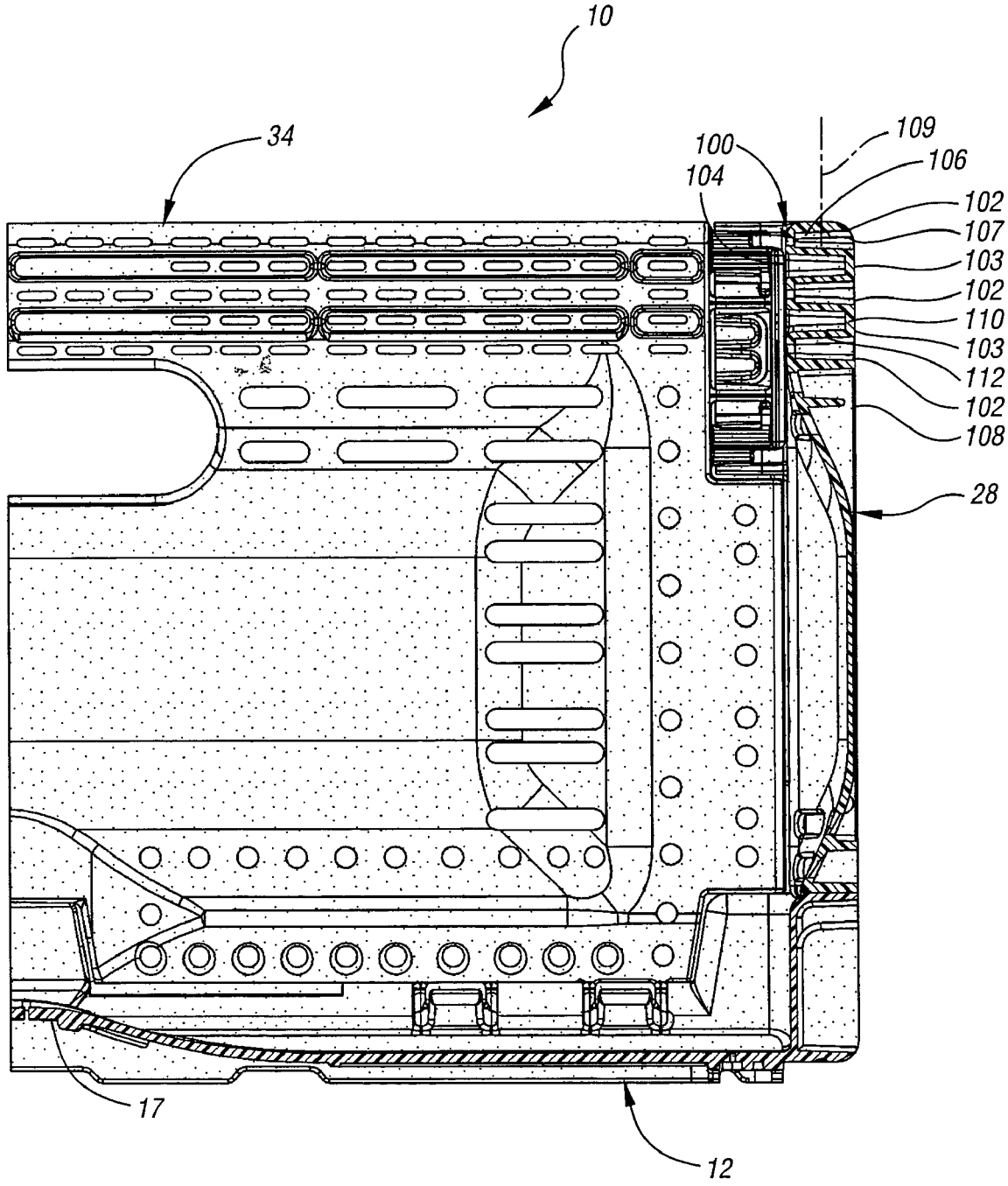
FIG. 7 is a cross-sectional view taken along the line 7—7 of FIG. 6.
Figure 11:
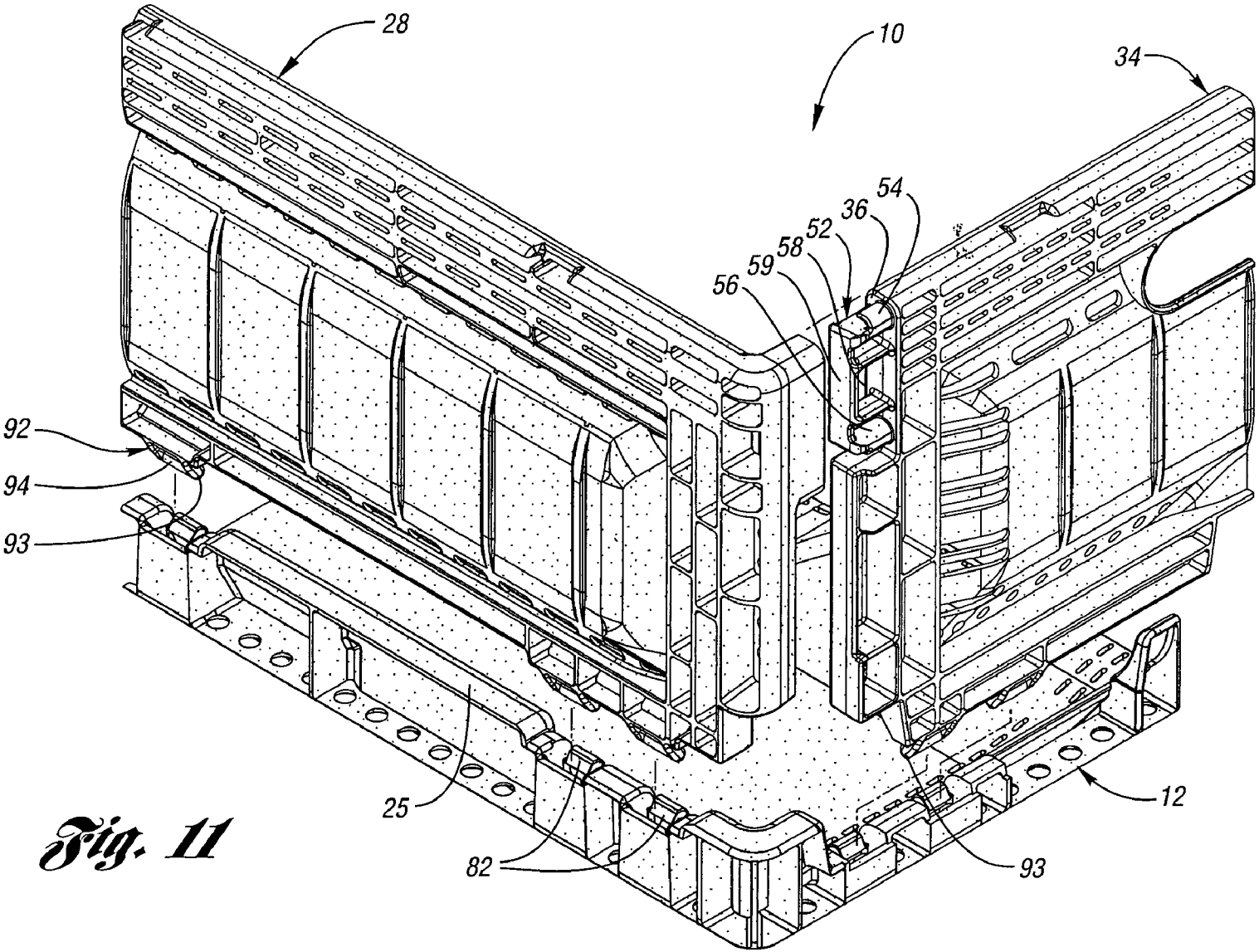
FIG. 11 is an exploded partial perspective view of the container of FIG. 1.
Figure 12:
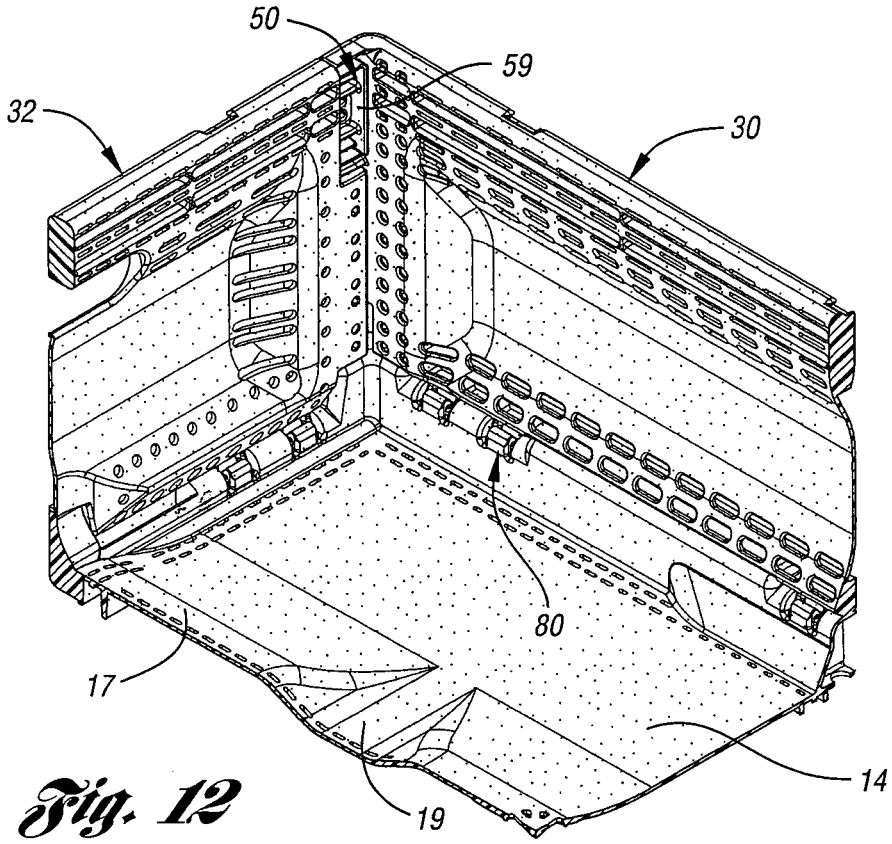
FIG. 12 is an interior corner perspective view of the container of FIG. 1.
Figure 13:
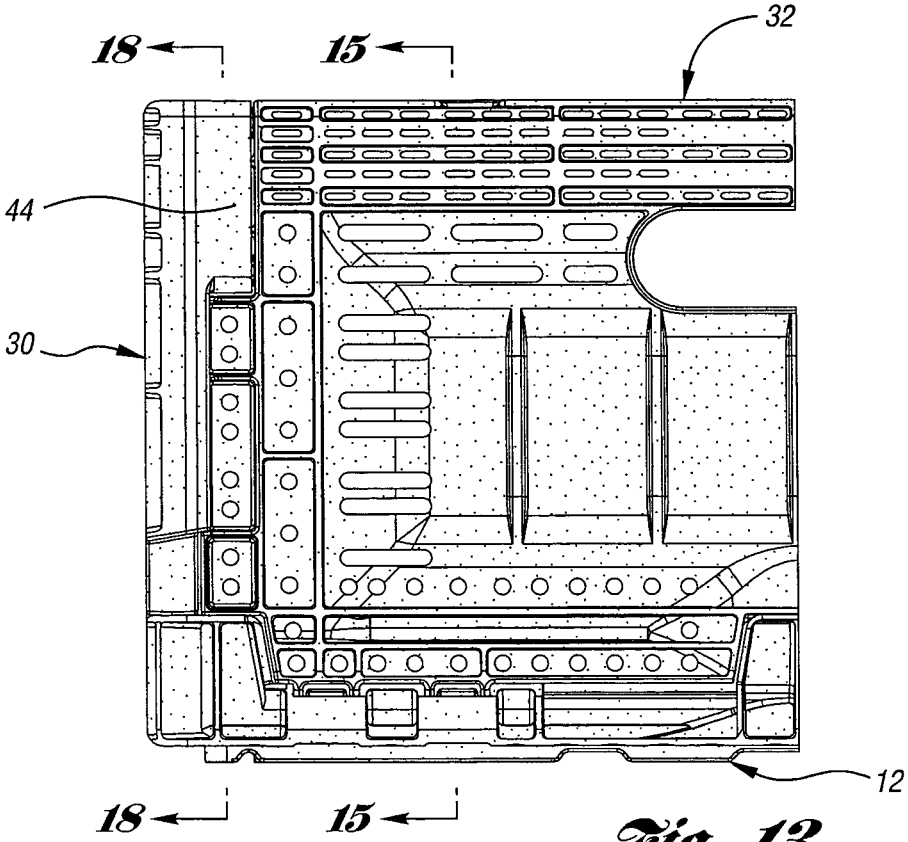
FIG. 13 is a partial elevational view of the container showing the end wall, similar to that shown in FIG. 4.
Figure 18:
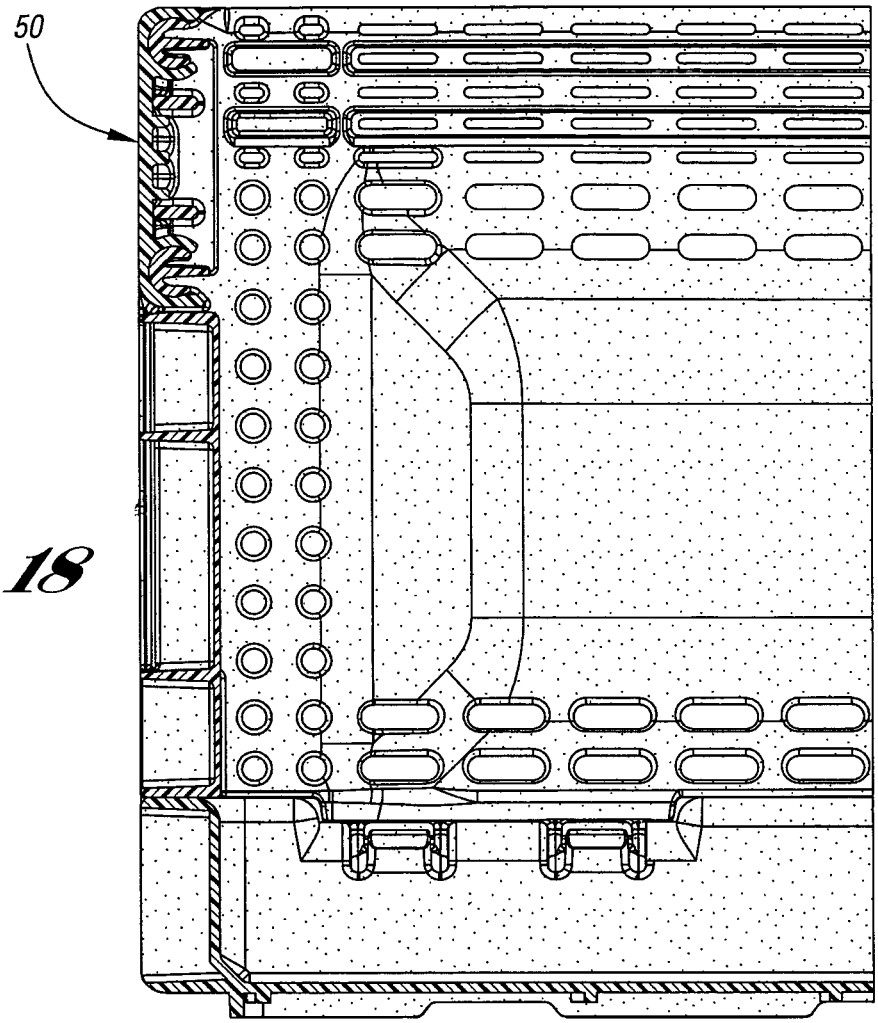
FIG. 18 is a quarter cross-sectional view taken along the line 18—18 of FIG. 13.
Figure 18A:
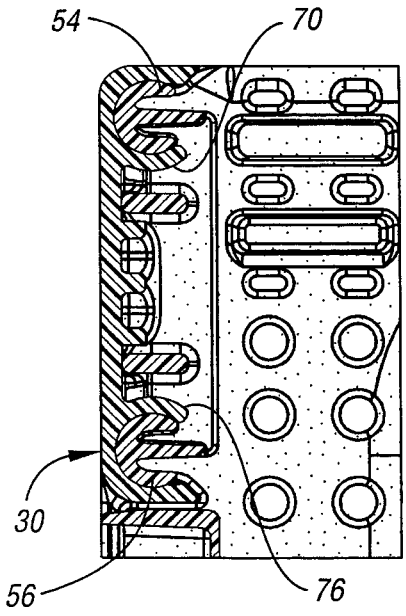
FIG. 18*a* is a magnified view of the latching system of FIG. 18.
Figure 18B:
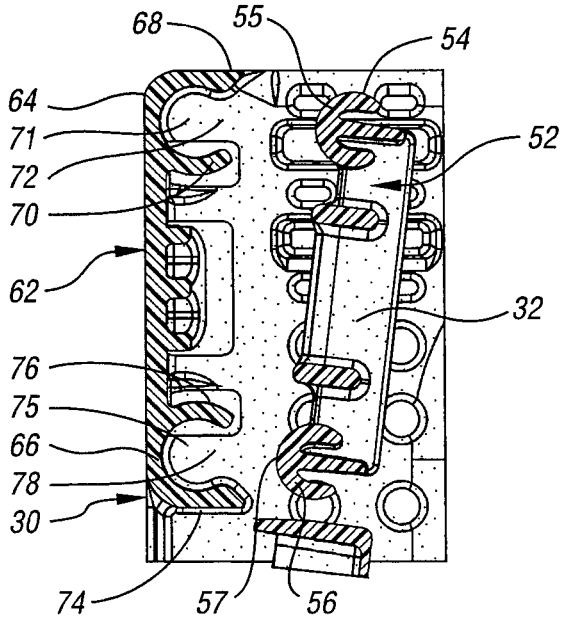
FIG. 18*b* is a magnified view of the latching system similar to FIG. 18*a*, but with the first and second latching portions slightly separated.
Figure 21:
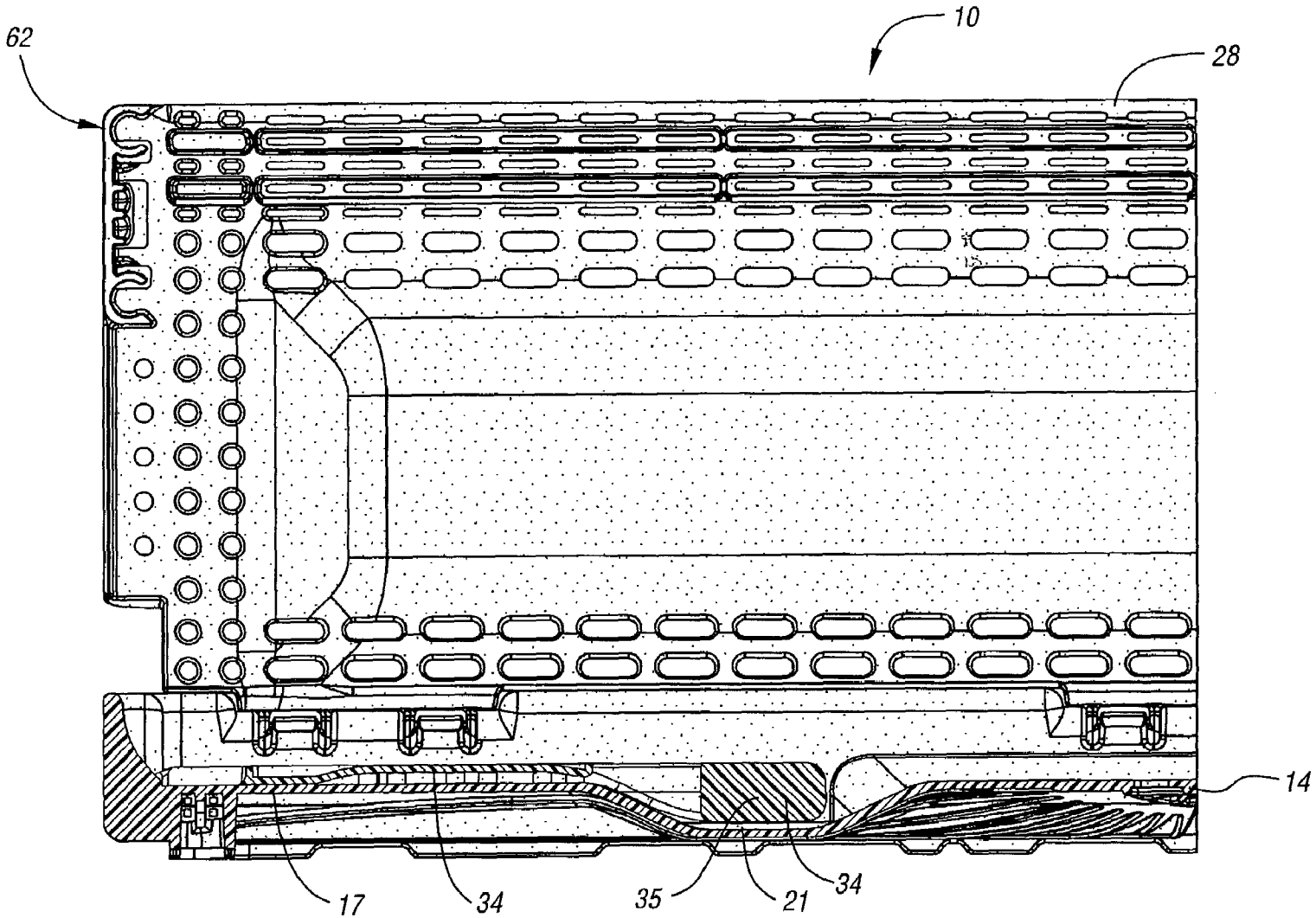
FIG. 21 is a partial cross-sectional view taken along line 21—21 of FIG. 19, showing the upper end wall resting in the recess of the floor member.
Figure 22A:
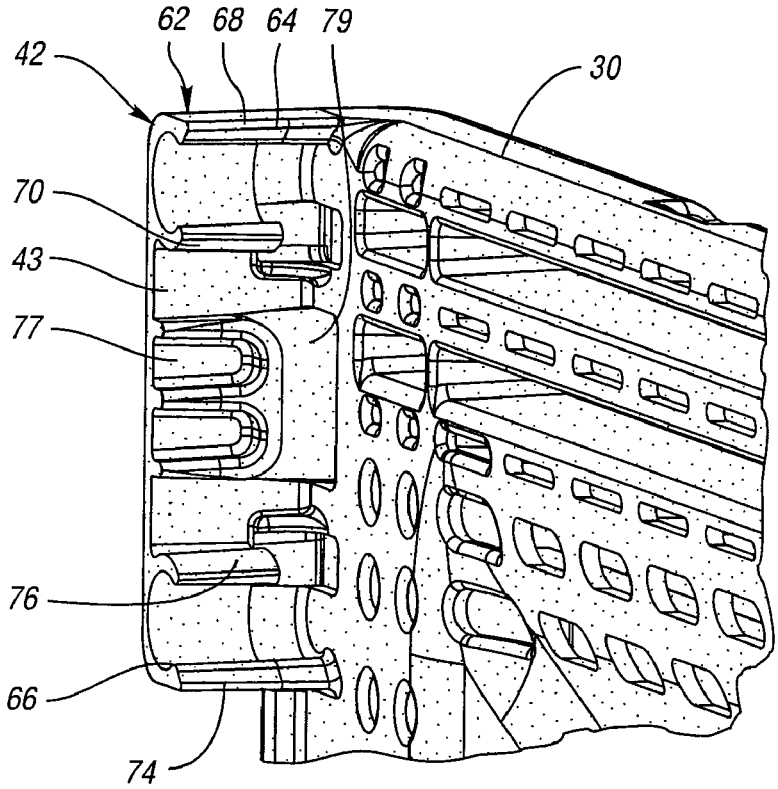
FIG. 22*a* is a partial perspective view of the interior surface of the side wall flange, showing the latch acceptance area.

According to the teachings of the present invention, container 10 includes a latching system (or wall retention system) 50 for retaining side walls (28,30) together with end walls (32,34) when container 10 is oriented in the assembled orientation, as in FIGS. 1, 7 and 18. Latching system 50 includes a first latch portion 52 on end walls 32, 34 (FIG. 11), and a second latch portion 62 disposed on the side walls 28,30 (FIGS. 18*b*, 21, 22). Particularly, each end wall 32,34 has a pair of lateral edges 36,38 which include the first latch portion 52 (latch member) extending therefrom. First latch portion 52 is shown as co-planar to its adjacent end wall. First latch portion 52 is disposed at the upper portion of lateral edges 36,38 proximate upper edge 33,35, and includes at least one, and preferably a pair of male latch portions 54,56 such as the dowels or pins having a bulbous portion illustrated herein, the dowels spaced apart from each other. An opening 58 is disposed between dowels 54,56 and an outer member 59 is disposed parallel to lateral edges 36,38 and extends between dowels 54,56. (See FIGS. 11, 18*b*.)

Figure 22B:
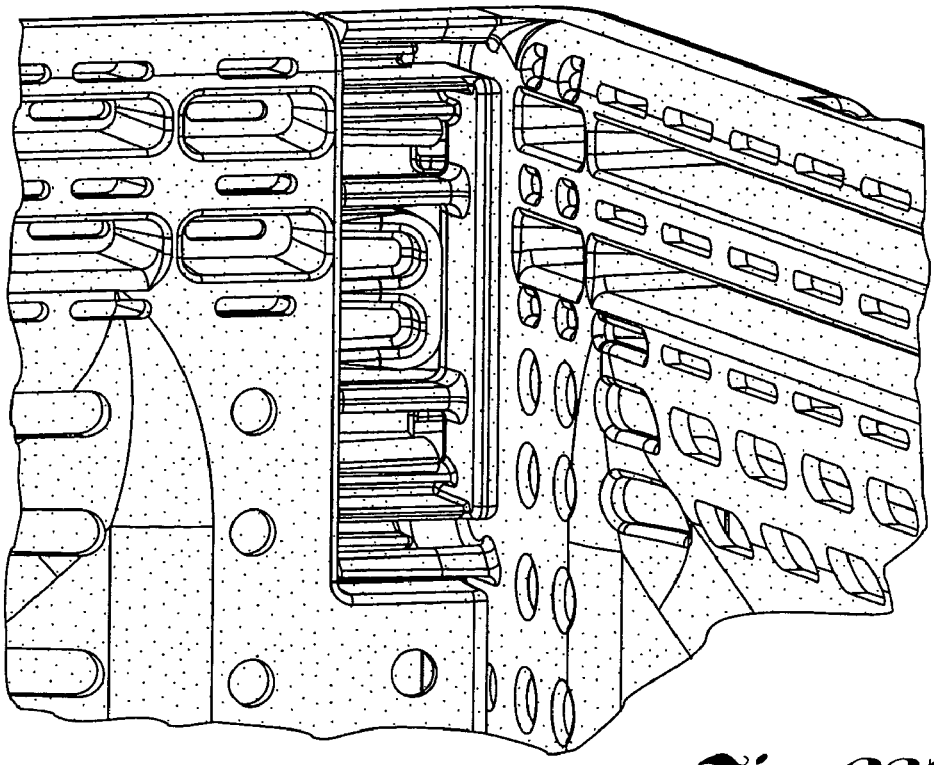
FIG. 22*b* is a partial perspective view of the latch assembly in the assembled position.

With reference to FIGS. 7 and 22*b*, second latch portion 62 (latch receiving portion) is formed on the inner surface of inwardly directed flanges 42, 44 of side walls 28,30. Latch receiving portion 62 corresponds to, and mates with latch member 52. As best illustrated in FIGS. 18, 18*a*, 18*b*, latch receiving portion 62 includes a female latch portion 64,66, such as the pair of spaced apart, flexible, deformable spring C-clips 64, 66 for receiving a corresponding dowel 54, 46, respectively, when the walls are moved into the assembled orientation. Upper C-clip 64 has an fixed upper edge 68 integrally formed with side walls 28,30, and a flexible lower edge 70 defining a dowel receiving area 71 having an opening 72 thereto. Lower C-clip 66 has a fixed lower edge 74 (integrally formed with side walls 28,30) and a flexible upper edge 76 defining an opening 78 thereto for a receiving area 75.

Thus, in use, when container 10 is moved from the inwardly folded orientation (FIG. 20) to the assembled orientation (FIG. 1), side walls 28,30 are rotated upwardly around hinge assembly 80, which stops at an angle substantially perpendicular to bottom panel 14 due many factors, including the interference of base wall surfaces 25,27 (extending between hinge portions 80) with the adjacent lower surfaces of side walls 28,30, the interference with the legs 93 of wall hinge 80 with base 12 during rotation (FIGS. 11 and 14), and also the configuration of hinge system 80. Subsequently, end walls 32,34 are rotated upwardly around hinge 80' (FIGS. 15, 15*a*), wherein the protrusion or bulbous portion 55,57 of dowels 54,56 are inserted via an interference fit and received in the respective openings 72,78 of C-clips 64,66. This interference fit causes lower edge 70 of upper clip 64 to expand and flex downward, thereby allowing dowel 54 be received within dowel receiving or acceptance area 71, under an interference fit. When dowel 54 is disposed in area 71, lower clip edge 50 springs back and returns to its original position, thereby impeding the dowel's 54 movement. Lower C-clip 66 operates similarly, except that upon insertion, upper flexible edge 76 flexes upward for allowing dowel 56 to move past. Thus, end walls 32,34 are prevented from folding outwardly through not only their hinge configuration 80 (see FIG. 15), but by their interference with sidewalls 28,30 when assembled. Accordingly, when assembled, latch member 52 is generally co-planar with inner surface of flanges 42, 44 and with latch receiving area 62.

Figure 8:
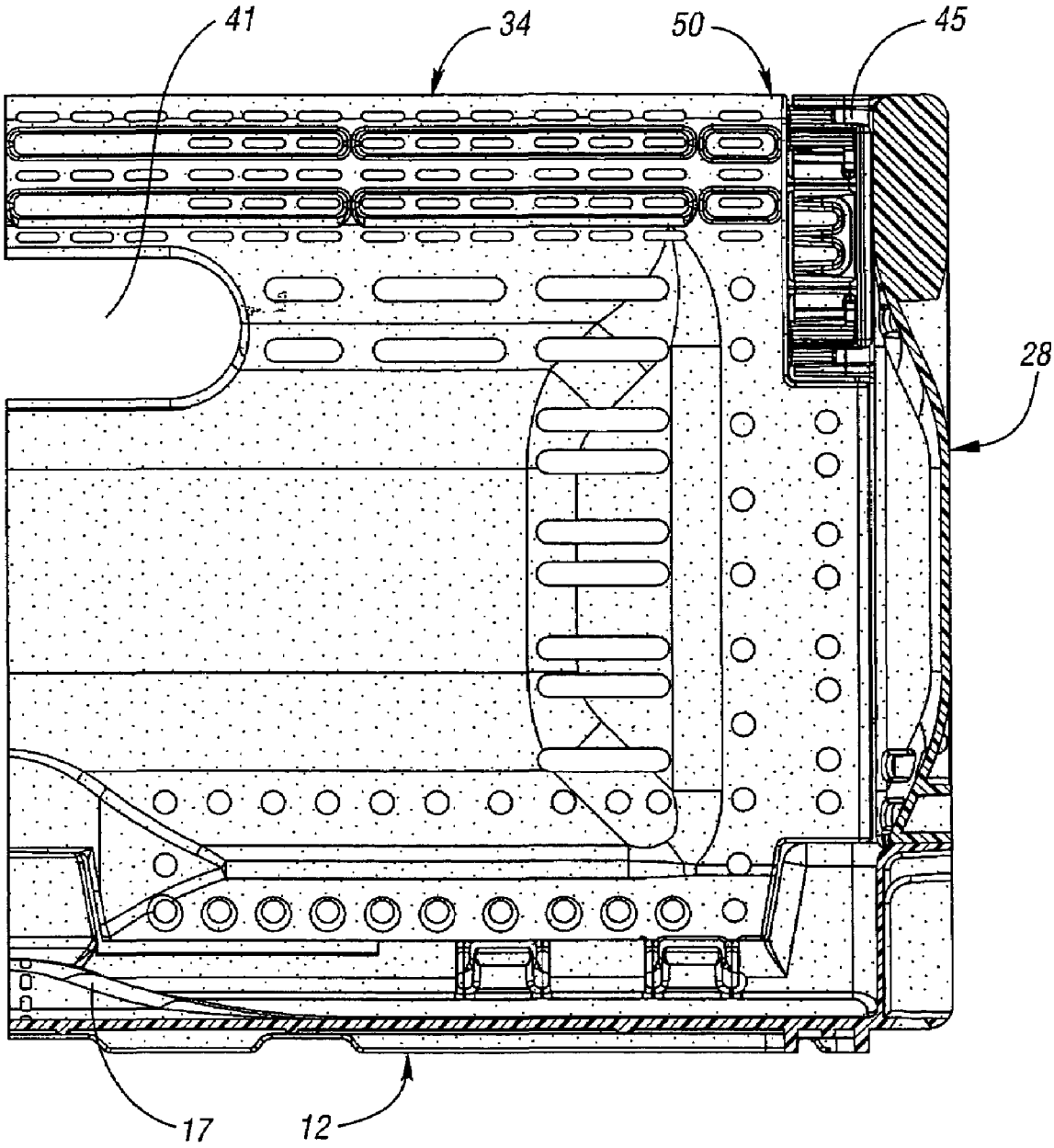
FIG. 8 is a cross-sectional view taken along the line 8—8 of FIG. 6.

As further illustrated in FIGS. 8, 18 and 22, inner surfaces 43,45 of flange portions 42,44, also include an anti-rotational portion (proximate latch receiving portion 62) having a member 77, and a recess 79 adjacent member 77, the recess corresponding to latch outer member 59 of end walls 32,34. In the assembled orientation, latch outer member 59 is received within recess 79, and is sandwiched between member 77 and sidewall panel 28,30 (FIG. 22*b*). Latch outer member 59, through its interference with the anti-rotational portions 77,79, impedes any lateral and rotational movement of sidewalls 28,30 when in the assembled position, particularly in the outward direction beyond 90° or any other predetermined angle.

In use, in order to collapse the assembled walls of container 10, a force (referred to as a kick-down or knock-down force) is applied to the exterior surfaces of end walls 32,34, sufficient to overcome the interference fit of C-clips 64,66 thereby causing dowels 54,56 to push out from opening 72 and release from C-clips 54,56. Thus end walls 32,34 are easily unlatched from the side walls and free to rotate inwardly (FIG. 20).

End walls 32,34 pivot inwardly around hinges 80 until they are disposed against bottom wall 14, whereby the upper portion 33, 35 of end walls 32,34 are disposed in the corresponding recesses 19,21 in upper surface 14 of bottom wall 14 (FIG. 21). Moreover, end walls 32, 34 have a lower inner surface 31 (FIG. 1) shaped to mate with and correspond to the raised portion 17 of floor 14 when in the inwardly folded position. Accordingly, through the use of recesses 19/21 and 31, container 10 provides for a lower profile when nested in the inwardly folded orientation, thus resulting in more efficient stacking height when such containers are stacked together. Recesses 19/21 and 31 allow for a more aggressive nesting increment not found on prior art containers, while still maintaining strength in the base through use of the central raised member 17. Subsequently, side walls 28,30 are rotated inwardly, pivoting around hinges 80, and resting on top of end walls 32,34 (FIG. 20). Accordingly, no extra handling is necessary to release the walls, as in the prior art wherein, for example, a user often needed to use both hands to unlock and move a single wall, which was often awkward and inconvenient. Further, as illustrated in FIGS. 19–20, when in the inwardly collapsed position, end wall 34 rotates away from the base periphery, giving outboard clearance for the flanged portions 42,44 of side wall 28 to engage portion 13 of base 12 when in the inwardly folded position (FIG. 20.) Such folding configuration wherein the end wall is folded inwardly first, and the side wall is rotated from an upstanding base flange, also permits the construction of a taller container.

To return container 10 to the assembled position, side walls 28,30 are raised upwards, pivoting around hinges 80, until they stop upon being oriented perpendicular to base 12 through the aforementioned interference between base and wall, assisted by the hinge system 80, thereby impeding the outward rotation of end walls, and also acting as a stop feature such that the sidewalls are positioned upright do not have to be manually held during the subsequent raising of the end walls. End walls 32,34 are then pivotably raised from base 12 until dowels 54,56 are received by C-clips 64,66 as described above.

Figure 14:
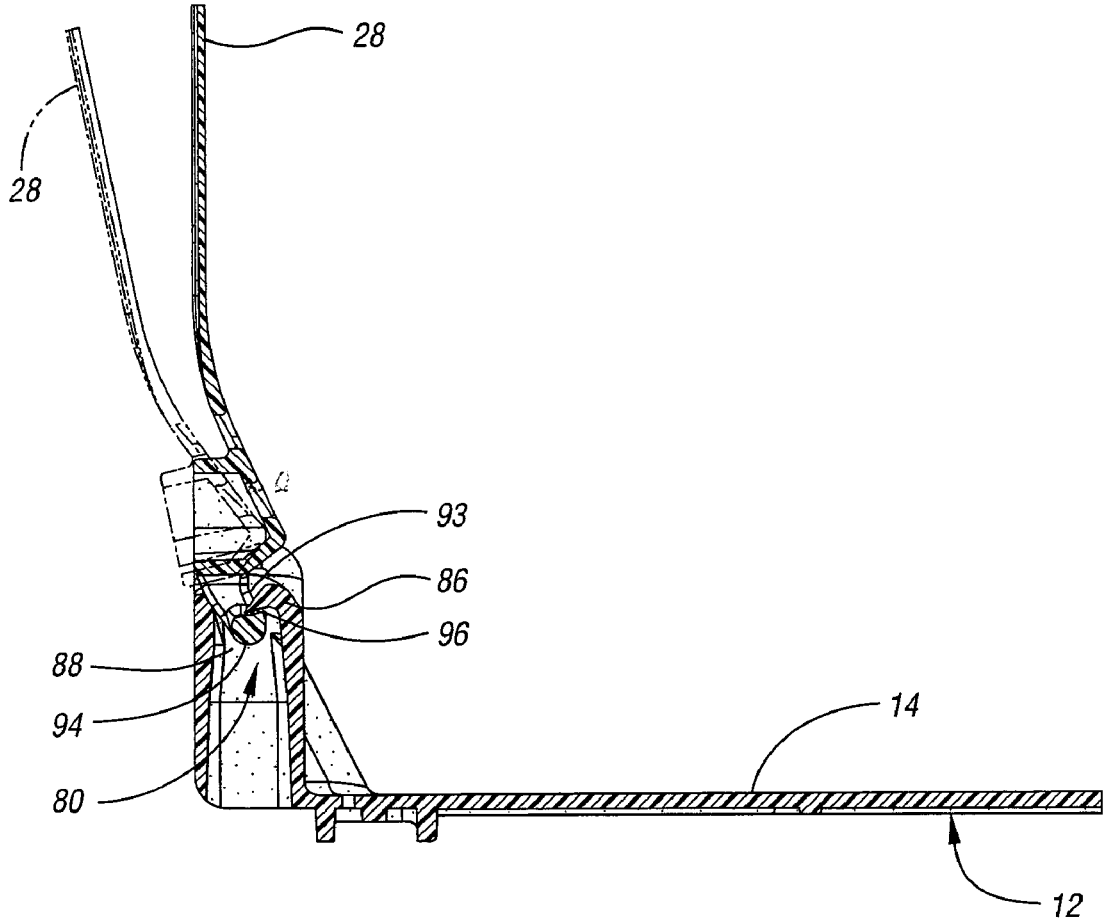
FIG. 14 is a cross-sectional view taken along line 14—14 of FIG. 6.
Figure 14A:
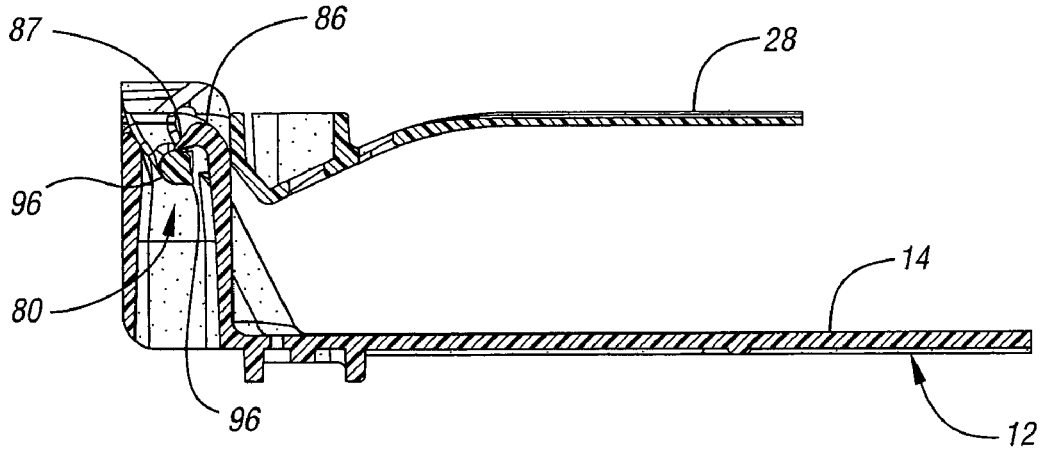
FIG. 14*a* is a cross-sectional view similar to that of FIG. 14, but with the sidewall in the inwardly collapsed position.
Figure 15:
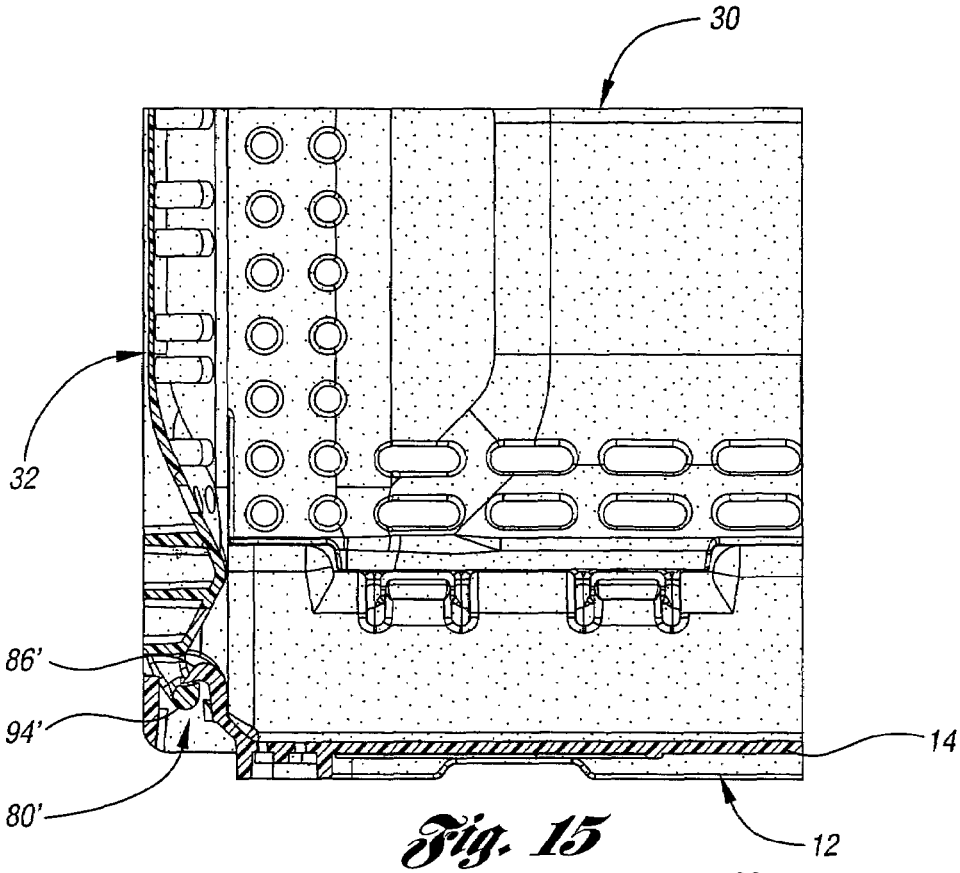
FIG. 15 is a cross-sectional view taken along the line 15—15 of FIG. 13.
Figure 15A:
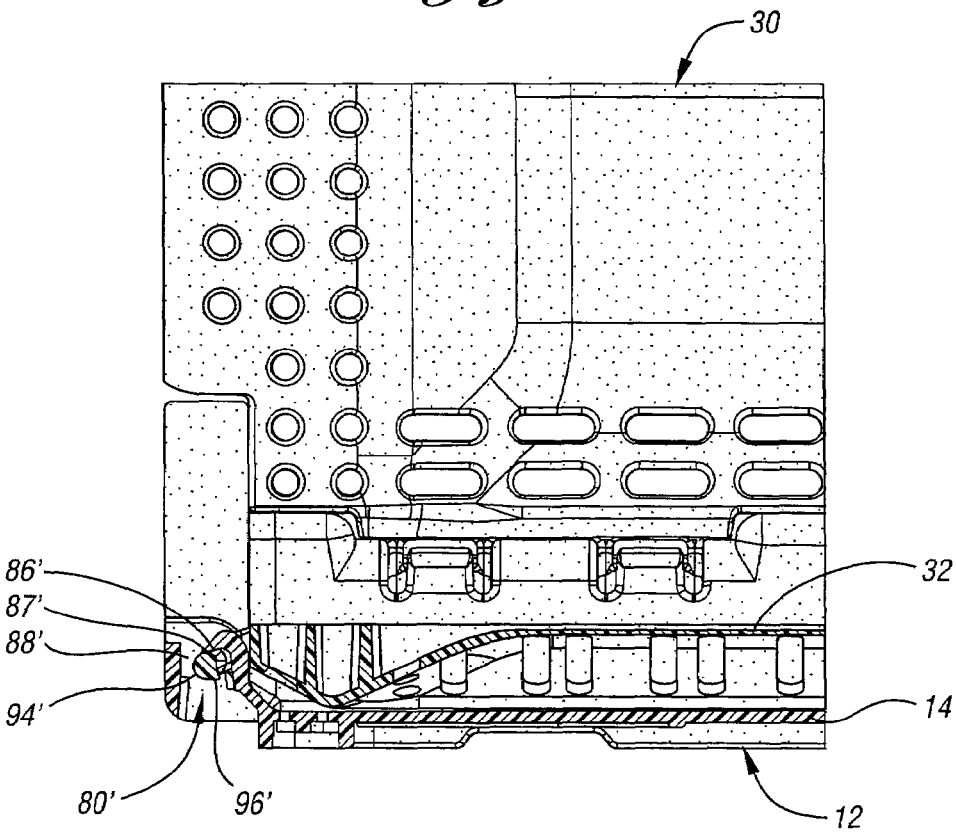
FIG. 15*a* is a cross-sectional view similar to that of FIG. 15, but with the end wall in the inwardly collapsed position.
Figure 16:
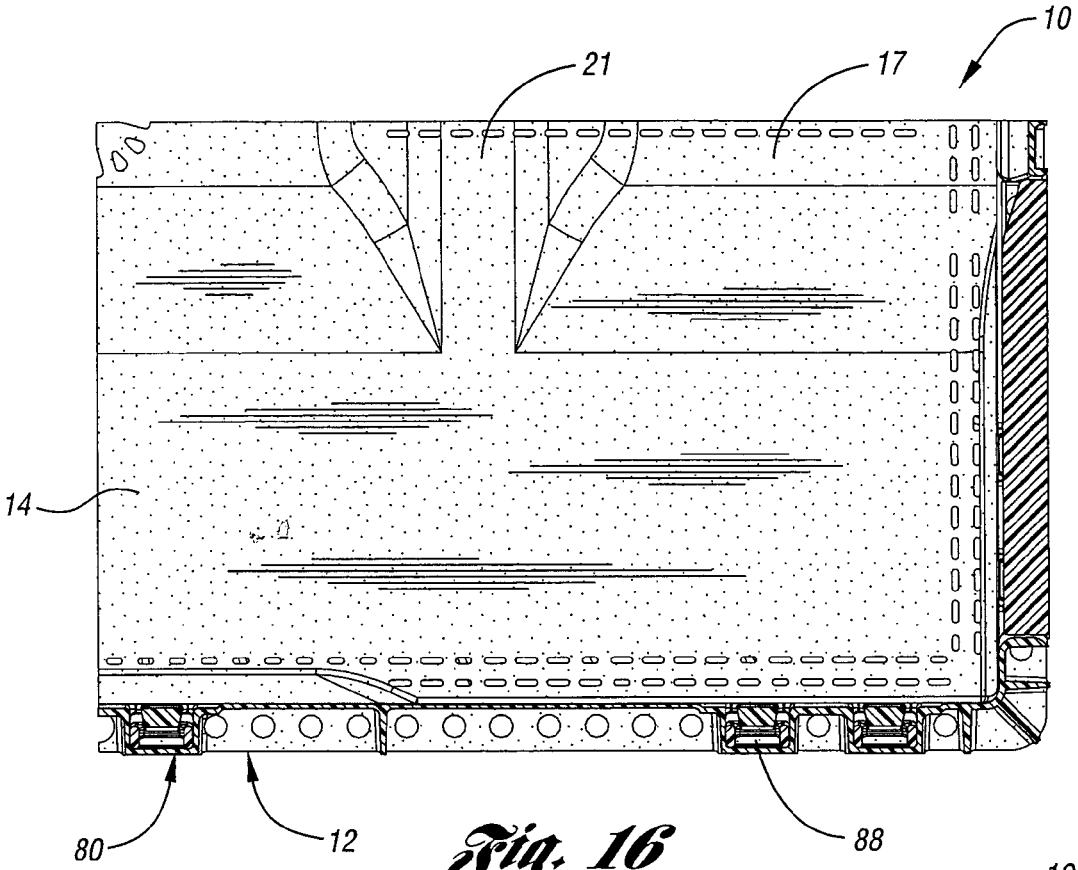
FIG. 16 is a quarter cross-sectional view taken along the line 16—16 of FIG. 6.
Figure 17:
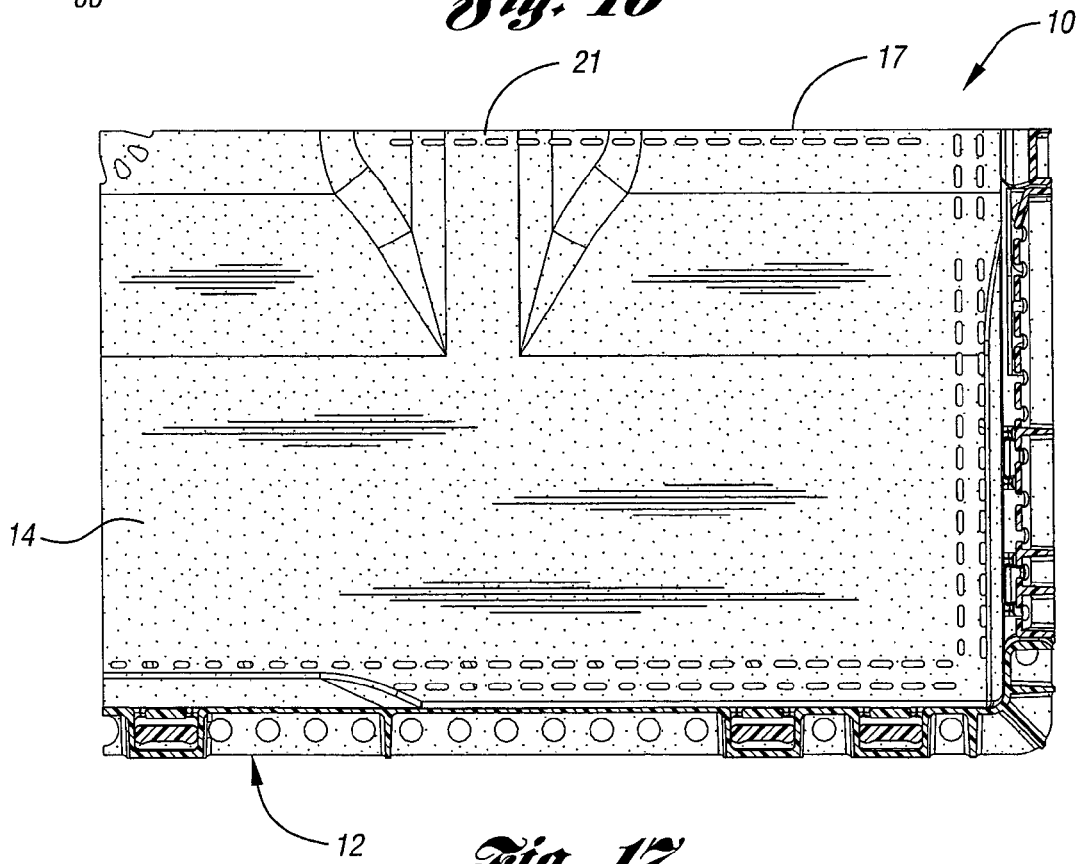
FIG. 17 is a quarter cross-sectional view taken along the line 17—17 of FIG. 6.

As shown in FIGS. 11, 14, 14*a*, 15, 15*a* hinging mechanism 80 includes adjoining base hinge portions 82 (or lower hinge members) and wall hinge portions 92 (or upper hinge members.) Base hinge portions 82 are spaced around the periphery of base 12 and include members 84 having a backdrafted portion 86 with a barbed edge 87 (resembling a hook member 86 having a downwardly directed tooth edge 87) and also having an opening 88 disposed therebehind. Each corresponding wall hinge portion 92 includes a plurality of elongate members 94 or bars extending from the lower edge of the respective side wall 28,30,32,34. Each wall hinge member 94 is substantially cam-shaped in cross-section, as illustrated in FIGS. 14, 14*a*. More particularly, member 94 is a semi-circular member having a radially extending projection tooth 96 and a flat surface portion 97 adjacent tooth 96. In order to attach the walls to the base 12 via hinge portions 82,92, each wall hinge member 94 is press fit into base opening 88 and is disposed under hook portion 86. Mounting of wall to base is preferably done when the respective wall is in the inwardly folded orientation (or non-upright orientation) such that tooth 96 of member 94 is directed downward and away from any interference with backdrafted portion 86 (FIG. 15*a*.)

As the wall is raised to the upright assembled position, the movement of tooth 96 is impeded by hook portion 86 due to interference between the parts, such that hook portion 86 hinders the movement of cam member 84 in the vertical direction. Thus, this feature makes separating the walls from the base while in the upright position relatively difficult. However, as noted above, disassembly may be done with little or no deformation when the wall is away from the upright position and at or proximate to the inwardly folded position. FIGS. 15,15*a* illustrate the hinge system 80' for end walls 32,34, where reference numerals corresponding to those features in FIGS. 14,14*a* have a prime (') designation. With reference to FIG. 15*b*, it is noted that when tooth 96 is oriented downwardly, the corresponding cam-shaped member 94 can be removed from opening, thereby disassembling the wall portion from base 12.

The resistance of the walls to being outwardly collapsed is illustrated in FIG. 14, wherein the wall shown in phantom has an interior force applied thereto, which could be applied manually or in the field if a crate is overfilled with product. Thus, as illustrated in FIG. 14, while the upper portion of wall 28 may deform temporarily under a given load, the rotational interference of latch portions 59 and 79 when container 10 is assembled prevents any permanent undesired outward folding of the wall.

In accordance with the present invention, container 10 further includes an improved wall configuration particularly applicable to withstand the knock-down forces to which container 10 may be subjected. The improved wall configuration also serves to counter-act part warpage during the molding and cooling processes. As illustrated in FIGS. 1, 7, and 9–10, each of side walls 28,30 and end walls 32,34 includes, respectively, an upper edge 46,48, 33,35. Proximate upper edges 46,48,33,35, each corresponding wall 28,30,32,34 includes an upper portion 100 having a configuration allowing for transferred stiffness and strength across the upper portion (for example, effectively transferring laterally outward a knock-down force which is applied to the area above handle 41 to the latch area.) This configuration also provides for improved strength and warping resistance of the walls. As illustrated representatively in FIG. 7, the vertical cross-section through upper portion 100 of wall 28 resembles a wave-form configuration defined by a pattern of alternating rows 102, 103 oriented horizontally, parallel to, and adjacent each other proximate their respective upper edges 46,48,33,35.

Figure 9:
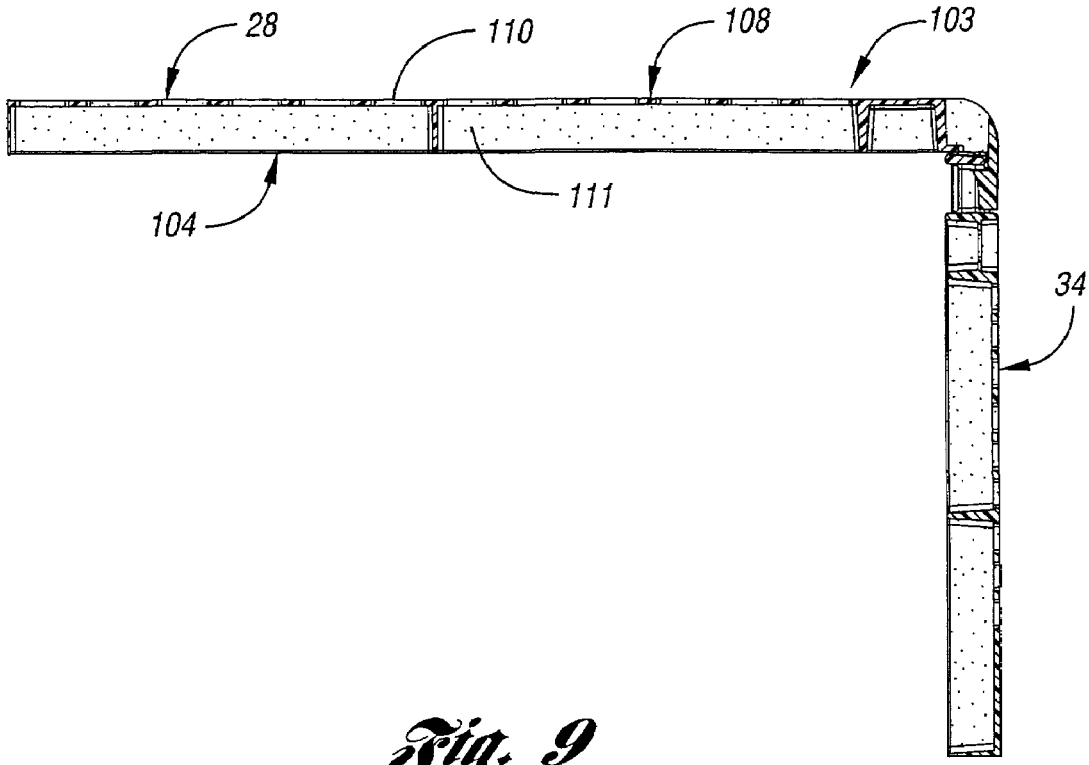
FIG. 9 is a cross-sectional view taken along the line 9—9 of FIG. 6.
Figure 10:
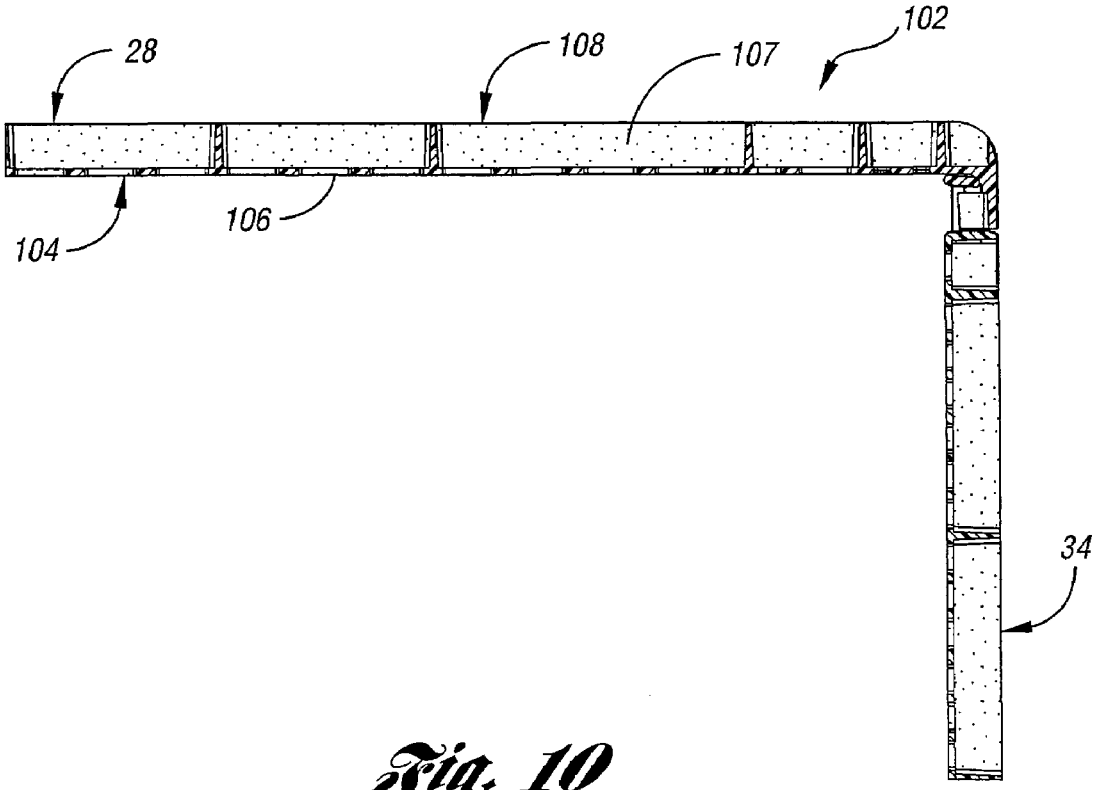
FIG. 10 is a cross-sectional view taken along the line 10—10 of FIG. 6.

As illustrated in FIGS. 7, 9–10, upper wall portion 100 is a single-walled member and preferably has a continuous undulating wave-like configuration having an inner (inwardly facing) surface 104 defined by a plurality of inwardly directed peaks 106, and an outer (outwardly facing) surface 108 defined by a plurality of outwardly directed peaks 110. Preferably, as shown in FIG. 7, upper portion 100 may have peaks 106,110 which are generally flat, and connected by band connect members (slightly tapered portions 112), to resemble a step wave or modified square wave. To enhance the strength properties of the walls, it is desirous to have as much material on the inner and outer surfaces 104,108 as possible, and also that such material is generally distributed uniformly away from a central plane 109. By way of example, as illustrated in FIG. 7, a plane 109 is shown parallel to and oriented mid-way between surfaces 104,108, illustrating that approximately half the material forming upper portion 100 is disposed on either side of plane 109, thus allowing for a more uniform distribution of plastic material and weight at the perimeter of the walls, where warping and deformation is most likely to occur, as well placing the most material away from plane 109. Thus, a wall that is 0.5 inch wide will have 50% wall material on one side of plane 109, and 50% inch wall material on the other side. To the contrary, prior art containers having ribs and cross-ribbing in these areas accordingly tend to have an uneven material distribution. In fact, for many containers, the ribs themselves are tapered, being thicker on the inside and smaller on the outside, thereby creating a more uneven material distribution, and thus a greater potential warping and bowing.

Particularly, the present design allows for optimal material distribution at the surfaces of the walls, particularly for container 10 which has walls 32,34 which are subject to the knock-down type force for unlatching the walls when moved to an inwardly folding position. FIG. 7 upper wall portion 100 may also be described as an inner surface 104 having a plurality of alternating inwardly-directed plateaus 106 and outwardly-directed recesses 107, which define a corresponding outer surface 108 having, respectively, a plurality of alternating inwardly-directed recesses 111 and a outwardly-directed plateaus 110. The wave-like design of the upper side and end walls enhances the warping resistance of the side walls by improving the material distribution in upper wall portion 100, and also distributes strength and force bearing properties laterally across the sidewalls, for example when subject to a kick-down force during disassembly.

Figure 6:
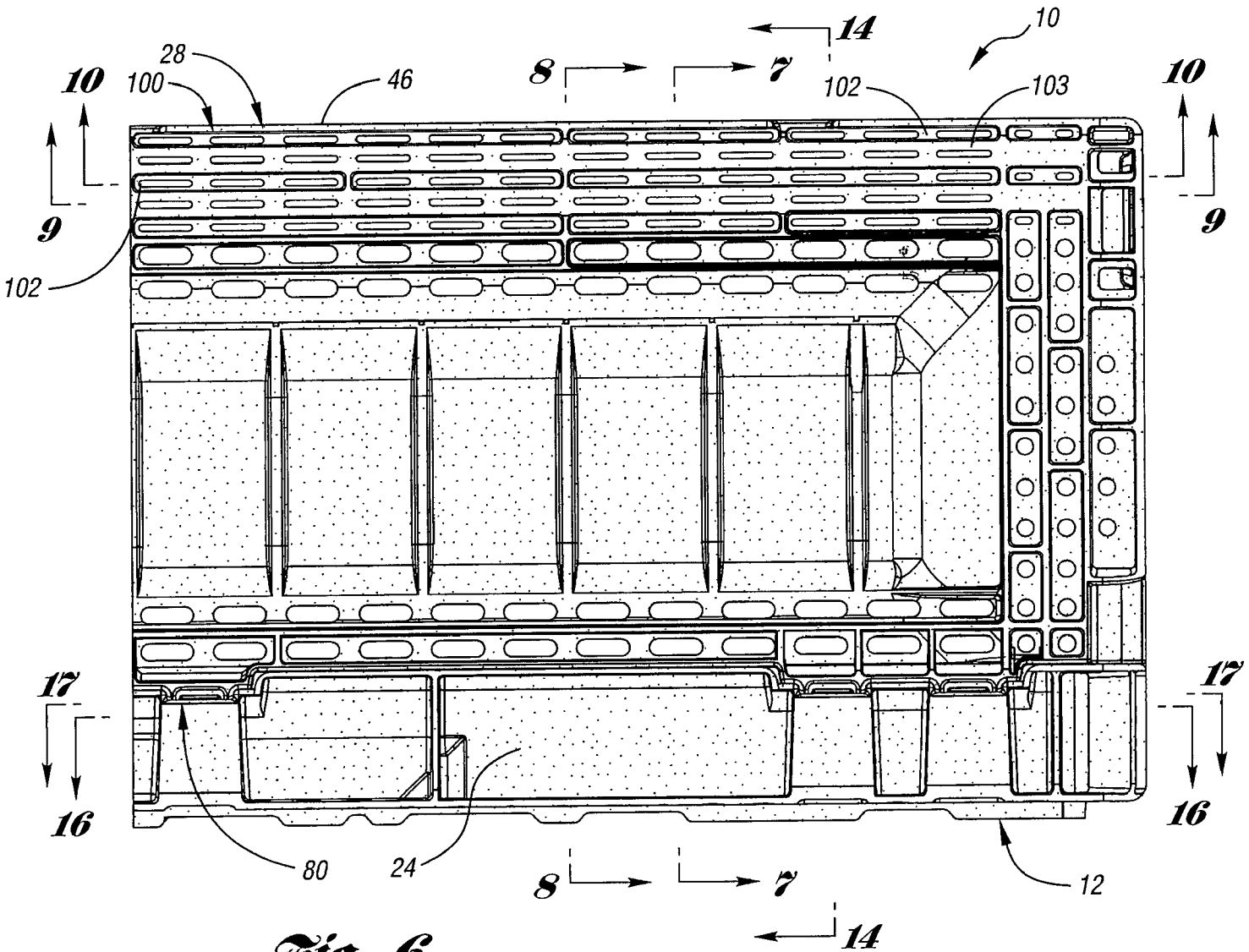
FIG. 6 is a partial elevational view of the container, showing the side wall, similar to that shown in FIG. 3.

FIG. 9 is a cross-sectional view taken along the line 9—9 of FIG. 6, where band 102 has an outer peak 110 defining outer surface 108. FIG. 10 is taken along line 10—10 of FIG. 6, showing band 103 with an inner peak 106, defining inner surface 104. As illustrated therein, band 102 has a peak 106 with a flat profile directed inward (FIG. 10) and band 103 has a peak 110 with a flat profile directed outward (FIG. 9). This design again produces a more even material distribution between the inner and outer surfaces of the relevant component, in this case walls 28,30,32,34 as well as more material placed as far from the center plane 109.

With respect to the venting holes 11, container 10 according to the present invention is particularly well-suited for storing bananas therein. Central portions 47, 49 of side and end walls, respectively, generally serve as the locations of contact for bananas which are generally stored in container 10 in a "hands down" orientation, with their tips and crowns disposed downward (but of course may also be stored in the "hands up" position.) It is preferable for the bananas to contact a solid and continuous construction of these portions of side walls 28,30 and end walls 32,34, which therefore increases the surface area of container 10 which is otherwise capable of submitting an opposite reactive force against the bananas when positioned in container 10. The bananas, accordingly, are shaped and oriented such that they do generally not contact the venting holes disposed on the upper and lower portions of the side and end walls.

It is understood, of course, that while the forms of the invention herein shown and described include the best mode contemplated for carrying out the present invention, they are not intended to illustrate all possible forms thereof. It will also be understood that the words used are descriptive rather than limiting, and that various changes may be made without departing from the spirit or scope of the invention as claimed below.

What is claimed is:

1. A collapsible container orientable between an assembled position and an collapsed position comprising:

a base member having a plurality of lower hinge members, each lower hinge member having a hook portion with a downwardly directed edge;

a pair of first opposed walls pivotably mounted to the base; and a pair of second opposed side walls pivotably mounted to the base and having a plurality of corresponding upper hinge members extending from a lower edge thereof, each upper hinge member having a cam-shaped member for engaging the hook portion, such that as the container is moved from the collapsed position to the assembled position, the edge of the hook member limits the vertical movement of the cam-shaped member, thereby preventing each of the pair of second opposed sidewalls from separating from the base when in the assembled position, one of the first and second side walls having a latch member extending laterally therefrom, the other of the first and second side walls having a flange having at least one latch acceptance member having a flexible portion for receiving a corresponding latch member therein in an interference fit when the container is oriented in the assembled position, the acceptance member having a rounded concave interior surface for receiving the latch member, wherein when the first and second side walls are pivoted from a collapsed position to an assembled position, the flexible portion is flexed to permit insertion of the latch member into the latch acceptance member.

2. The collapsible container of claim 1 wherein the pair of first side walls are moveable from the assembled position to a collapsed position by a force exerted on the first side walls thereby causing the spring portion to flex from the first position to the second position to release the latch member from the clip member and subsequently return to the first position.

3. The collapsible container of claim 2 wherein the spring portion returns to the first position after the latch member is released from the clip member.

4. The collapsible container of claim 1, wherein the first side walls are pivotable outwardly from the collapsed position on the base to the assembled position.

5. The collapsible container of claim 1 wherein at least one of the first side walls and the second side walls comprises a wall structure having an upper wall portion, the upper wall portion including a plurality of alternating row members extending at least partially across the wall structure proximate an upper surface of the wall structure and oriented substantially parallel thereto, each of the plurality of row members having a first surface and second surface co-planar with an inner and an outer surface, respectively, of the upper wall portion, wherein at least one of the plurality of row members has a peaked first surface and recessed second surface, and an other of the plurality of row members has a recessed first surface and a peaked second surface, and members extending between the first and second peak.

6. The wall structure of claim 5, wherein adjacent ones of said peaked first surfaces define a recessed first surface therebetween.

7. The wall structure of claim 6, wherein adjacent ones of said peaked second surfaces define a recessed second surface therebetween.

8. The collapsible container of claim 1 wherein the collapsible container is collapsible by a force exerted on one of the first side wall and the second side wall thereby causing the flexible portion to flex to release the latch member from the latch acceptance member.

9. A collapsible container comprising:

a floor member, a first side wall pivotably mounted to the floor member; and a second side wail pivotably mounted to the floor member, the first and second side walls being selectively connected to one another by a latch, the latch comprising at least one latch member and at least one flexible clip portion, the flexible clip portion having a latch member acceptance area and a flex portion, the flex portion having a rounded interior surface leading to a free inner end, wherein when the first and second side walls are pivoted from a collapsed position to an upright assembled position, the at least one latch member is inserted into the clip portion, thereby expanding the flex portion until the latch member is received within the latch member acceptance area and the flex portion returns to its rest position, impeding the release of the at least one latch member.

10. The collapsible container of claim 9, wherein the at least one latch member includes a bulbous head for being received by the clip portion in an interference fit, the bulbous head including at least one, curved member extending away from a forward end of the latch member.

11. The collapsible container of claim 9, wherein the flexible clip portion is a C-shaped clip member and the flex portion is defined by an end of the C-shaped clip.

12. The collapsible container of claim 9 wherein the crate is collapsible by a force exerted on one of the first side wall and the second side wall thereby causing the flex portion to flex from the rest position to release the latch member from the clip portion and subsequently return to the rest position.

13. A collapsible container arranged for movement between a collapsed orientation and an assembled orientation, comprising:

a base;

a side wall pivotably attached to the base, the first side wall having a lateral edge having a latch member disposed thereon; and a second side wall pivotably attached to the base, the second side wall having a flange inwardly depending therefrom, the flange having a surface with at least one latch receiving member formed therein, the latch receiving member having a receiving area and a corresponding opening defined by a fixed edge and a flexible edge spaced apart from each other, the opening relatively smaller than the latch member, the flexible edge having a generally rounded interior surface, the latch member having a generally complementary rounded exterior surface, wherein when the container is moved from the collapsed orientation to the assembled orientation, the walls pivot upward such that the latch member enters the opening and displaces the flexible edge of the latch receiving member slightly, whereupon the latch member is received within the receiving area for securing the latch member.

14. The collapsible container of claim 13, wherein the flexible edge is displaced in the vertical direction.

15. The collapsible container of claim 13 wherein to move the container to a collapsed position from the assembled position, a force is exerted against a surface of one of the first and second side walls sufficient for the flexible edge of the latch receiving member to deflect temporarily to permit the removal of the latch member from the latch receiving member.

16. The collapsible container of claim 13 wherein the latch member includes a center portion having a forward end and a pair of curved members extending rearwardly away from the forward end of the center portion to free ends.

* * * * *

UNITED STATES PATENT AND TRADEMARK OFFICE

CERTIFICATE OF CORRECTION

PATENT NO. : 7,128,231 B2
APPLICATION NO. : 10/677499
DATED : October 31, 2006
INVENTOR(S) : Overholt It is certified that error appears in the above-identified patent and that said Letters Patent is hereby corrected as shown below:

In Column 12, Claim 1, Line 31 of the issued patent, “an” should read as --a--.

In Column 12, Claim 2, Line 63 of the issued patent, “a” should read as --the--.

In Column 13, Claim 5, Line 14 of the issued patent, please insert --a-- after “and” and before “second.”

In Column 13, Claim 5, Line 20 of the issued patent, please insert --the-- after “and” and before “second.”

In Column 14, Claim 12, Line 7 of the issued patent, “crate” should read as --collapsible container--.

In Column 14, Claim 15, Line 42 of the issued patent, “a” should read as --the--.

Signed and Sealed this

Twenty-fifth Day of December, 2007

JON W. DUDAS
*Director of the United States Patent and Trademark Office*